US007502572B2

(12) United States Patent
Watanabe et al.

(10) Patent No.: US 7,502,572 B2
(45) Date of Patent: Mar. 10, 2009

(54) IMAGE FORMING APPARATUS AND IMAGE FORMING METHOD

(75) Inventors: Takeshi Watanabe, Yokohama (JP); Masashi Takahashi, Yokohama (JP); Mitsuaki Kouyama, Higashi-kurume (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 266 days.

(21) Appl. No.: 11/481,347

(22) Filed: Jul. 5, 2006

(65) Prior Publication Data

US 2008/0008489 A1 Jan. 10, 2008

(51) Int. Cl.
*G03G 15/00* (2006.01)

(52) U.S. Cl. ..... 399/71

(58) Field of Classification Search ..... 399/38, 399/71, 343, 350, 352, 353, 354, 358, 360
See application file for complete search history.

(56) References Cited

U.S. PATENT DOCUMENTS

| | | | | |
|---|---|---|---|---|
| 4,727,395 | A | 2/1988 | Oda et al. | |
| 5,027,161 | A * | 6/1991 | Kume et al. | 399/222 |
| 5,895,141 | A * | 4/1999 | Budnik et al. | 399/58 |
| 5,937,227 | A * | 8/1999 | Wong et al. | 399/49 |
| 6,055,406 | A * | 4/2000 | Kawai et al. | 399/360 |
| 6,118,952 | A * | 9/2000 | Furuya | 399/50 |
| 6,823,152 | B2 * | 11/2004 | Kida | 399/101 |
| 6,990,298 | B2 * | 1/2006 | Hamano et al. | 399/66 |
| 2005/0069355 | A1 | 3/2005 | Watanabe et al. | |
| 2006/0056857 | A1 | 3/2006 | Watanabe et al. | |
| 2007/0274738 | A1 | 11/2007 | Watanabe et al. | |
| 2008/0002997 | A1 | 1/2008 | Watanabe et al. | |
| 2008/0008498 | A1 | 1/2008 | Watanabe et al. | |

FOREIGN PATENT DOCUMENTS

| | | |
|---|---|---|
| JP | 06-118857 | 4/1994 |
| JP | 09-251264 | 9/1997 |
| JP | 10-031404 | 2/1998 |
| JP | 2002-006630 | 1/2002 |

* cited by examiner

*Primary Examiner*—Hoan H Tran
(74) *Attorney, Agent, or Firm*—Amin, Turocy & Calvin, LLP

(57) ABSTRACT

It is an object of the invention to provide an image forming apparatus and an image forming method that can reduce generation of a waste toner.

An image forming apparatus according to the invention includes an image bearing member on which a toner image is formed, a cleaner that transfers a toner image formed on the surface of the image bearing member and, then, removes a part of a toner remaining on the image bearing member and allows the remainder to pass as a passing toner, a passing toner amount detecting unit for detecting or estimating an amount of passing toner that passes the cleaner, and a cleaner control unit that sets, on the basis of an amount of passing toner detected by the passing toner amount detecting unit, a target value of the amount of passing toner and controls a cleaning operation by the cleaner.

20 Claims, 17 Drawing Sheets

FIG.3(a)

| TONER PARTICLE DIAMETER | IMAGE TYPE | PRINT MODE | RESOLUTION | UPPER LIMIT OF AMOUNT OF CLEANING PASSING TONER (μg/cm2) |
|---|---|---|---|---|
| 6.5μm | CHARACTER CHART | CHARACTER MODE | 1200dpiBINARY | 16 |
| | MEMORY CHART | NORMAL MODE | 600dpiQUATERNARY | 14 |
| | | HIGH DEFINITION MODE | 1200dpiBINARY | 10 |
| | | HIGH GRADATION MODE | 1200dpiQUATERNARY | 6 |
| 5μm | CHARACTER CHART | CHARACTER MODE | 1200dpiBINARY | 19 |
| | MEMORY CHART | NORMAL MODE | 600dpiBINARY | 17 |
| | | HIGH DEFINITION MODE | 1200dpiBINARY | 12 |
| | | HIGH GRADATION MODE | 1200dpiQUATERNARY | 7 |
| 3.8μm | CHARACTER CHART | CHARACTER MODE | 1200dpiBINARY | 22 |
| | MEMORY CHART | NORMAL MODE | 600dpiBINARY | 19 |
| | | HIGH DEFINITION MODE | 1200dpiBINARY | 14 |
| | | HIGH GRADATION MODE | 1200dpiQUATERNARY | 8 |

FIG.3(b)

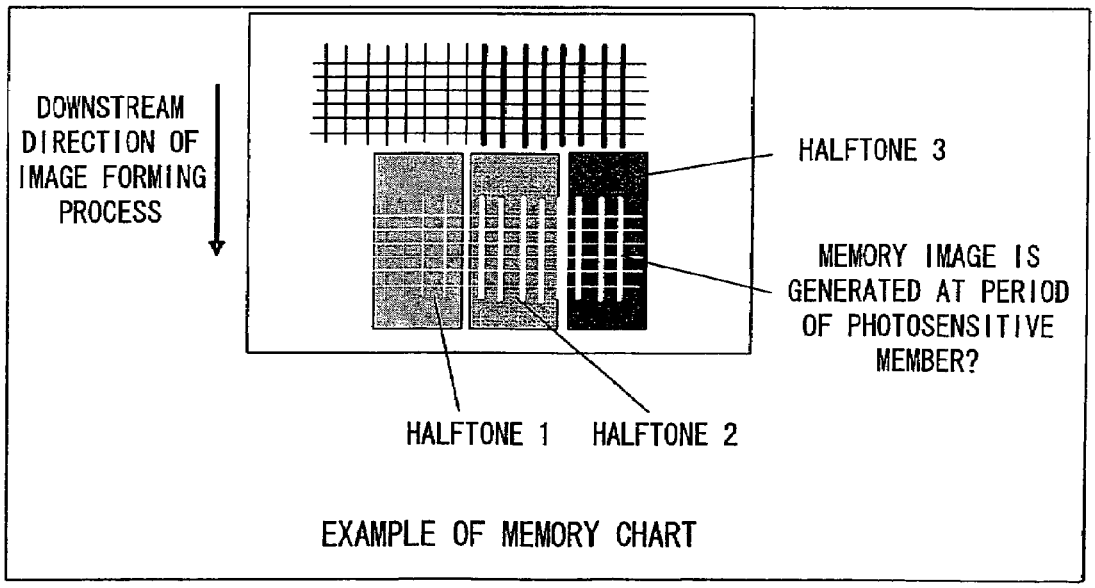

FIG.16

| EXPERIMENT No | TONER PARTICLE DIAMETER (μm) | SET SCALING FACTOR OF TARGET VALUE FROM UPPER LIMIT OF AMOUNT OF TONER PASSING BRUSH | FEEDBACK TO BRUSH CONDITIONS | PRESENCE OR ABSENCE OF OCCURRENCE OF IMAGE DEFECT (PRESENCE = ×) | FEEDBACK TO BRUSH CONDITIONS | PRESENCE OR ABSENCE OF OCCURRENCE OF IMAGE DEFECT (PRESENCE = ×) | FEEDBACK TO BRUSH CONDITIONS | PRESENCE OR ABSENCE OF OCCURRENCE OF IMAGE DEFECT (PRESENCE = ×) | FEEDBACK TO BRUSH CONDITIONS | PRESENCE OR ABSENCE OF OCCURRENCE OF IMAGE DEFECT (PRESENCE = ×) | FEEDBACK TO BRUSH CONDITIONS | PRESENCE OR ABSENCE OF OCCURRENCE OF IMAGE DEFECT (PRESENCE = ×) | AMOUNT OF WASTE TONER (MEASUREMENT mg/1000 SHEETS) |
|---|---|---|---|---|---|---|---|---|---|---|---|---|---|
| | | | START TIME | 0~200 | AFTER 200 SHEETS | 200~400 | AFTER 400 SHEETS | 400~600 | AFTER 600 SHEETS | 600~800 | AFTER 800 SHEETS | 800~1000 | |
| COMPARATIVE EXAMPLE | 6.5 | BRUSH PERIPHERAL SPEED FIXED TO 1.75 TIMES | | ○ | | ○ | | ○ | | ○ | | | 1,800 |
| 1 | | 0.8 | CARRIED OUT | ○ | NOT CARRIED OUT | △ (CHARACTER) | NOT CARRIED OUT | × | NOT CARRIED OUT | × | NOT CARRIED OUT | × | 990 |
| 2 | | 0.8 | CARRIED OUT | ○ | CARRIED OUT | ○ | CARRIED OUT | ○ | CARRIED OUT | △ (CHARACTER) | CARRIED OUT | ○ | 970 |
| 3 | | 0.7 | CARRIED OUT | ○ | CARRIED OUT | ○ | CARRIED OUT | ○ | CARRIED OUT | ○ | CARRIED OUT | ○ | 1,100 |
| 4 | 5 | 0.8 | CARRIED OUT | ○ | NOT CARRIED OUT | ○ | NOT CARRIED OUT | ○ | NOT CARRIED OUT | ○ | NOT CARRIED OUT | ○ | 860 |
| 5 | | 0.85 | CARRIED OUT | ○ | NOT CARRIED OUT | △ (CHARACTER) | NOT CARRIED OUT | △ (HIGH IMAGE QUALITY) | NOT CARRIED OUT | × | NOT CARRIED OUT | × | 790 |
| 6 | | 0.85 | CARRIED OUT | ○ | CARRIED OUT | ○ | CARRIED OUT | ○ | CARRIED OUT | ○ | CARRIED OUT | ○ | 800 |
| 7 | 3.8 | 0.85 | CARRIED OUT | ○ | NOT CARRIED OUT | ○ | NOT CARRIED OUT | ○ | NOT CARRIED OUT | ○ | NOT CARRIED OUT | ○ | 620 |
| 8 | | 0.9 | CARRIED OUT | ○ | NOT CARRIED OUT | △ (HIGH IMAGE QUALITY) | NOT CARRIED OUT | △ (HIGH IMAGE QUALITY) | NOT CARRIED OUT | × | NOT CARRIED OUT | × | 590 |
| 9 | | 0.9 | CARRIED OUT | ○ | CARRIED OUT | ○ | CARRIED OUT | ○ | CARRIED OUT | ○ | CARRIED OUT | ○ | 590 |

FIG.17

| EXPERIMENT No | TONER PARTICLE DIAMETER (μm) | TRANSFER SYSTEM | AMOUNT OF TRANSFER RESIDUAL TONER (μg/cm2) | SET SCALING FACTOR OF TARGET VALUE FROM UPPER LIMIT OF AMOUNT OF TONER PASSING BRUSH | FEEDBACK TO BRUSH CONDITIONS | PRESENCE OR ABSENCE OF OCCURRENCE OF IMAGE DEFECT (PRESENCE = ×) | FEEDBACK TO BRUSH CONDITIONS | PRESENCE OR ABSENCE OF OCCURRENCE OF IMAGE DEFECT (PRESENCE = ×) | FEEDBACK TO BRUSH CONDITIONS | PRESENCE OR ABSENCE OF OCCURRENCE OF IMAGE DEFECT (PRESENCE = ×) | FEEDBACK TO BRUSH CONDITIONS | PRESENCE OR ABSENCE OF OCCURRENCE OF IMAGE DEFECT (PRESENCE = ×) | FEEDBACK TO BRUSH CONDITIONS | PRESENCE OR ABSENCE OF OCCURRENCE OF IMAGE DEFECT (PRESENCE = ×) | AMOUNT OF WASTE TONER (MEASUREMENT mg/1000 SHEETS) |
|---|---|---|---|---|---|---|---|---|---|---|---|---|---|---|---|
| | | | | | START TIME | 0～200 | AFTER 200 SHEETS | 200～400 | AFTER 400 SHEETS | 400～600 | AFTER 600 SHEETS | 600～800 | AFTER 800 SHEETS | 800～1000 | |
| 10 | 5 | CORONA | 35 | 0.8 | CARRIED OUT | ○ | NOT CARRIED OUT | △ (HIGH IMAGE QUALITY) | NOT CARRIED OUT | × | NOT CARRIED OUT | × | NOT CARRIED OUT | × | 1,550 |
| 4 | | ROLLER | 25 | | CARRIED OUT | ○ | NOT CARRIED OUT | ○ | NOT CARRIED OUT | ○ | NOT CARRIED OUT | ○ | NOT CARRIED OUT | ○ | 860 |
| 11 | | CORONA | | | CARRIED OUT | ○ | NOT CARRIED OUT | ○ | NOT CARRIED OUT | ○ | NOT CARRIED OUT | △ (HIGH IMAGE QUALITY) | NOT CARRIED OUT | × | 870 |
| 12 | | CORONA | | | CARRIED OUT | ○ | CARRIED OUT | ○ | CARRIED OUT | ○ | CARRIED OUT | ○ | CARRIED OUT | ○ | 900 |

IMAGE FORMING APPARATUS AND IMAGE FORMING METHOD

BACKGROUND OF THE INVENTION

1. Field of the Related Art

The present invention relates to an image forming apparatus and an image forming method, and, more particularly to an image forming apparatus and an image forming method that can reduce a waste toner after transfer.

2. Description of the Related Art

In recent years, a reduction in size and improvement of an image quality of electrophotographic apparatuses have advanced and the electrophotographic apparatuses have been used in various places and applications. According to the reduction in size and the improvement of an image quality, importance of replacement work for consumables and maintenance work such as replacement of components has also been increasing. Maintenance most frequently performed by users in the electrophotographic apparatuses is replacement work for toner cartridges followed by disposal of waste toners.

When the users dispose of waste toners, it is likely that soil due to the toners occurs in the work. Moreover, generation of wastes as waste toners adversely affects the environment and is not economically efficient. In this way, the disposal of waste toners gives a negative image for both the users and the society in general.

Thus, as a form specialized in easy maintenance, there is a form of unitizing plural sections of an electrophotographic apparatus with relatively high frequency of maintenance and replacing the sections as a cartridge. In this unitization, a photosensitive member, a developing device, a cleaner, a waste toner box, and the like are unitized as a process unit integrally constituted. This process unit is constituted to be detachably attachable to an image forming apparatus. Consequently, a user intending to perform disposal of a waste toner can dispose of the waste toner simply by replacing the process unit periodically.

However, such a cartridge system also has a problem. Since the process unit is entirely replaced, even components that have not reached the end of replacement cycles and are still usable are replaced with other components.

For example, in the case of a cartridge in which a photosensitive member, a charger, and a cleaner are integrated, if the cleaner are worn, even if the photosensitive member is still usable, all the components are replaced. As a result, cost of consumables increases.

Moreover, in recent years, according to the appearance of a photosensitive member using $\alpha$-Si and an organic photosensitive member provided with a surface layer with high hardness on the surface thereof, a replacement cycle of the photosensitive member has become longer. On the other hand, in order to extend a life of the cleaner to make a replacement cycle thereof longer, a structure of the cleaner itself is inevitably complicated. Therefore, a size of the cleaner is increased, making it difficult to apply the cleaner to a photosensitive member having a small diameter.

Thus, in a patent document 1 (JP-A-6-118857) and a patent document 2 (JP-A-10-31404), a method of detachably attaching a cleaner to a photosensitive member to allow a user to easily replace the cleaner is proposed.

However, even if the cleaner is replaced in this way, when an amount of waste toner is large, frequency of replacement of the cleaner has to be increased, a size of a cleaner unit itself has to be increased, or the cleaner and a waste toner tank have to be arranged separately to replace only the waste toner tank. Therefore, the problem described above is not still solved.

Further, considering that there is no problem if a waste toner is not generated, a waste-tonerless process is also proposed. In a patent document 3 (U.S. Pat. No. 4,727,395), a technique for collecting a transfer residual toner in a developing device without cleaning the transfer residual toner to prevent a waste toner from being generated is disclosed.

This is a system referred to as a cleanerless process. However, this system has a problem in that a high image quality is not obtained because a transfer residual toner is a hindrance at the time of exposure. Moreover, paper powder or dust may be mixed in the transfer residual toner. If the paper powder or the dust mixed in the transfer residual toner entirely enters a developing device, the paper powder or the dust could cause deterioration in an image quality. Since the transfer residual toner contains a large quantity of toner with poor performance that could not eventually be transferred, if the toner is entirely collected in the developing device, like the paper powder and the like, the toner causes deterioration in an image quality later.

In a patent document 4 (JP-A-2002-6630), a technique for actively depositing a toner uniformly on a photosensitive member after transfer in order to reduce deterioration in an image quality due to an exposure failure caused by a transfer residual toner is disclosed. In this method, since the toner is uniformly deposited on the photosensitive member, image unevenness undoubtedly becomes less conspicuous.

However, ideally, it is preferable that an amount of toner adhering to a photosensitive member is smaller. Thus, the method of intentionally depositing the toner on the photosensitive member is against the original form of use of the toner. It cannot be said that the method is an efficient method of use of the toner and is a positive solution as measures against deterioration in an image quality due to a residual toner.

In a patent document 5 (JP-A-9-251264), an example in which only a toner with polarity thereof inversed of a transfer residual toner is collected by a bias and a toner charged in a regular polarity is used in a cleanerless process is disclosed. However, in this method, since only the toner inversely charged can be collected, if an amount of transfer residual toner of the regular polarity is simply large, since the toner cannot be collected by a cleaner, image memory occurs to deteriorate an image quality.

SUMMARY OF THE INVENTION

The invention has been devised in view of the problems and it is an object of the invention to provide an image forming apparatus and the like and an image forming method that can reduce generation of a waste toner by cleaning a part of a transfer residual toner and leaving an amount of toner in a range not hindering the next image formation on a photosensitive member (causing the amount of toner to pass a cleaning unit) rather than cleaning the entire transfer residual toner.

In order to solve the problems, an image forming apparatus according to an aspect of the invention includes: an image bearing member on which an electrostatic latent image formed on a surface thereof is visualized by a supplied toner to form a toner image; a cleaner that transfers a toner image formed on the surface of the image bearing member to a transfer member and, then, removes a part of a toner remaining on the image bearing member and allows the remainder to pass as a passing toner; a passing toner amount detecting unit for detecting or estimating an amount of a passing toner that passes the cleaner; and a cleaner control unit that sets, on the basis of an amount of passing toner detected by the passing toner amount detecting unit, a target value of the amount of the passing toner and controls a cleaning operation by the cleaner.

An image forming apparatus according to another aspect of the invention includes: image bearing means on which an electrostatic latent image formed on a surface thereof is visualized by a supplied toner to form a toner image; cleaner means for transferring a toner image formed on the surface of the image bearing means to a transfer member and, then, removing a part of a toner remaining on the image bearing means and allowing the remainder of the toner not removed to pass as a passing toner; passing toner amount detecting means for detecting or estimating an amount of a passing toner that passes the cleaner means; and cleaner control means for controlling, on the basis of an amount of passing toner detected by the passing toner amount detecting means, a cleaning operation by the cleaner means such that the amount of the passing toner reaches a target value.

Still another aspect of the invention is an image forming method of forming an electrostatic latent image on the surface of an image bearing member, supplying a toner to visualize the latent image with the toner, transferring an image visualized using the toner to a transfer member, and removing a residual toner remaining on the surface of the image bearing member with a cleaner, the image forming method including: detecting or estimating an amount of the toner that is not removed from the image bearing member by the cleaner and remains on the image bearing member to pass the cleaner; setting a target value of the amount of the passing toner on the basis of a result of the detection or the estimation; and controlling the cleaner with respect to the target value.

DESCRIPTION OF THE DRAWINGS

FIG. 1(*b*) is a schematic side view showing a modification of FIG. 1(*a*);

FIG. 2(*b*) is a schematic diagram for explaining a process unit detachably attachable to an apparatus body;

FIG. 3(*a*) is a table showing an experiment result of an amount of cleaning passing toner that does not cause a problem of an image;

FIG. 3(*b*) is a diagram showing an example of a memory chart;

FIG. 10(*b*) is a schematic diagram showing a state at the time when the cleaner is removed;

FIG. 13(*b*) is a side view of the developing device shown in FIG. 13(*a*);

FIG. 16 is a table showing a measurement result of an amount of waste toner; and FIG. 17 is a measurement result of an amount of waste toner measured with a transfer system changed from that in FIG. 16.

DESCRIPTION OF THE EMBODIMENT

An embodiment of the invention will be hereinafter explained with reference to the drawings.

Figure 1:
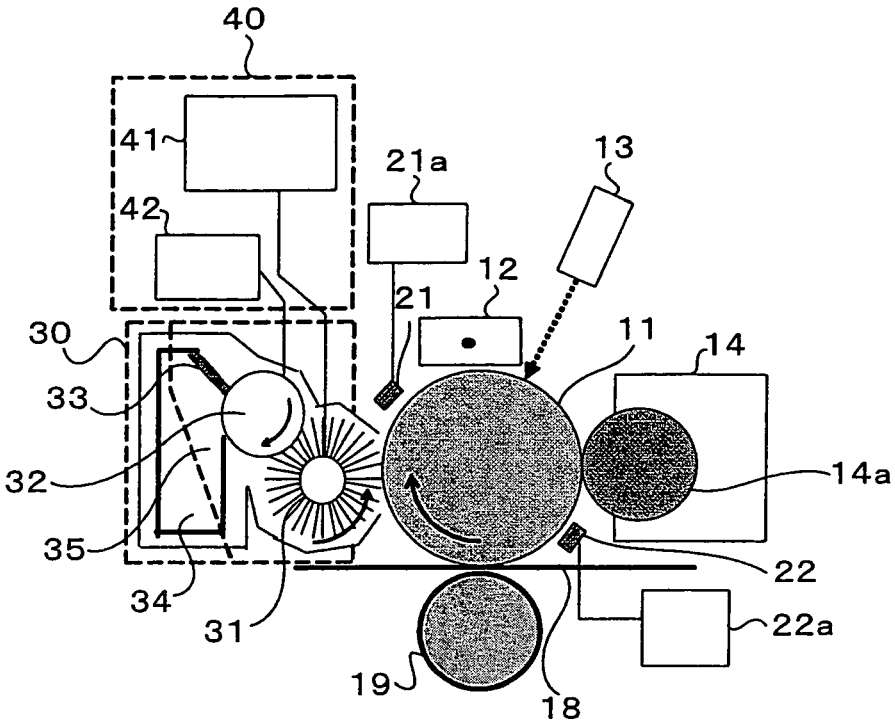
FIG. 1(*a*) is a schematic side view showing an example of an embodiment of the invention.
Figure 1:
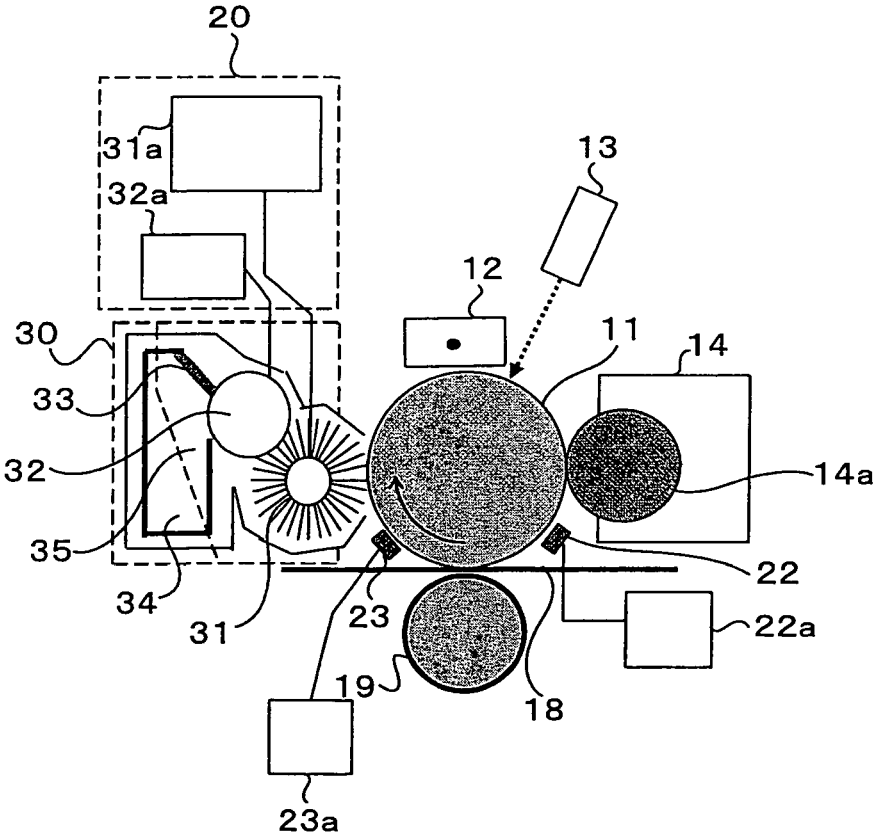

FIG. 1(*a*) is a schematic diagram showing an image forming apparatus using an electrophotographic system as an embodiment of the invention.

This image forming apparatus includes a photosensitive member (an image bearing member or image bearing means) 11, a charger 12, an exposing device 13, a developing device 14, a cleaner (cleaning means) 30, a cleaner control unit (cleaner control means) 40, reflectance sensors 21 and 22, and sensor circuits 21*a* and 22*a* that control the reflectance sensors 21 and 22. The reflectance sensor 21 constitutes a passing toner amount detecting unit or passing toner amount detecting means of the invention.

The photosensitive member 11 constitutes an image bearing member (equivalent to image bearing means) with an organic or amorphous silicon photosensitive layer provided on a conductive substrate. The photosensitive member 11 will be explained with an organic photosensitive member charged in a negative polarity as an example.

The photosensitive member 11 is uniformly charged to, for example, −500 V by the charger 12 such as a well-known roller charger, corona charger, or scorotron charger and, then, subjected to exposure of the exposing device 13 by a laser beam, an LED, or the like subjected to image modulation to have an electrostatic latent image formed on the surface thereof. In this case, a potential at the surface of the photosensitive member exposed is, for example, about −80 V.

Thereafter, visualization of the electrostatic latent image is performed by the developing device 14. The developing device 14 forms bristles by a carrier on a developing roller 14*a* including a magnet in accordance with, for example, a two-component development system in which a non-magnetic toner charged in a negative polarity and a magnetic carrier are mixed and applies about −200 to −400 V to the developing roller 14*a* to thereby deposit a toner in an exposing portion on the surface of the photosensitive member 11 and not to deposit the toner on a non-exposing portion. Besides, as the developing device 14, there is one that adopts a one-component developing system for performing development using only a toner without using carrier.

Moreover, a toner image on the photosensitive member 11 is transferred onto paper or an intermediate transfer member serving as the transfer member 18. Supply of an electric field in that case is performed via a transferring member such as the transfer roller 19 or a corona charger brought into contact with the transfer member 18 from the rear of the transfer member 18. If the transfer member 18 is an intermediate transfer belt, the supply of an electric field is performed by a transferring member such as a transfer roller, a transfer blade, or a transfer brush brought into contact with the rear surface of the belt. A voltage applied to the transferring member is about +300 V to +2 kV.

Residual toner disposal in the embodiment of the invention will be hereinafter explained. Prior to the explanation, for reference, an example of waste toner disposal in the past will be explained using FIG. 2. Reference numerals and signs in FIG. 2 identical with those in FIG. 1 denote the identical objects or equivalents thereof.

Figure 2B:
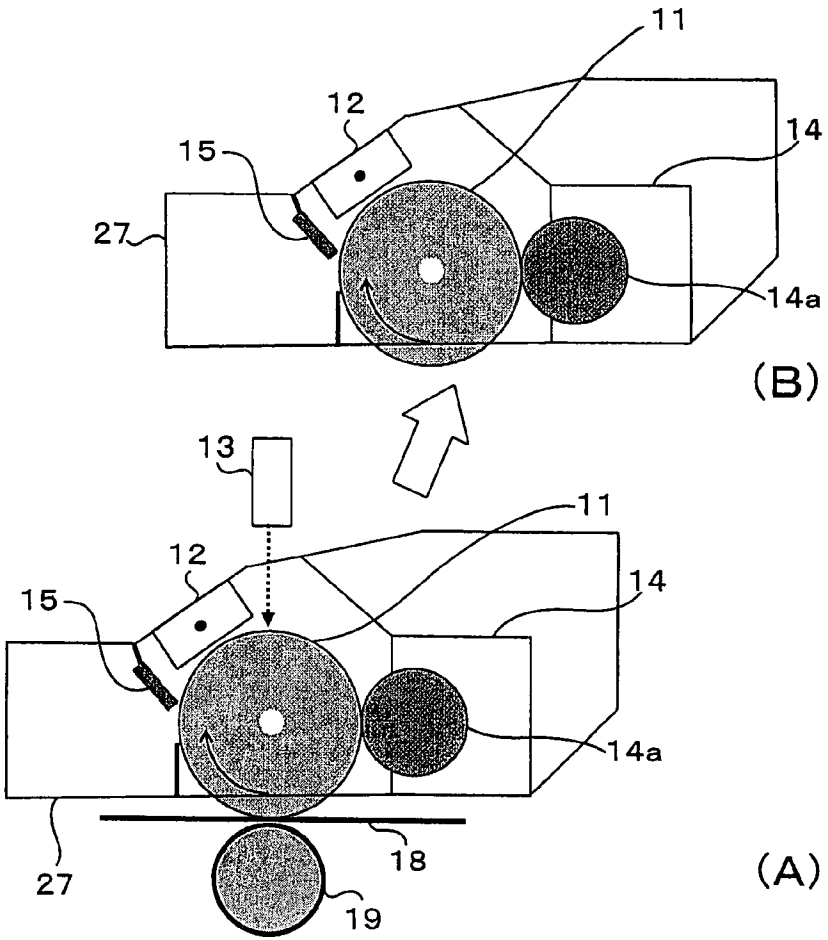
FIG. 2(*a*) is a schematic side view showing a conventional example corresponding to FIG. 1(*a*)
Figure 2A:
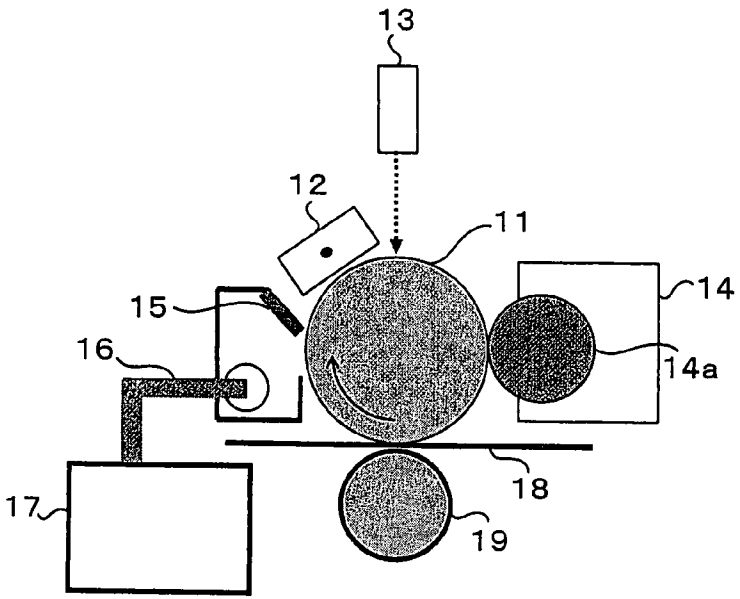

As shown in FIG. 2(*a*), in the past, there is known waste toner disposal in which the entire residual toner remaining on the photosensitive member 11 is removed without being subjected to control at all by a cleaning blade 15 and sent to a waste toner box 17 through a conveyance path 16 exclusively used for waste toner disposal and this box 17 is replaced.

When a process unit is constituted as a cartridge, for example, a photosensitive member, a cleaner, a waste toner box, and the like are integrally constituted. In some cases, as shown in FIG. 2(*b*), even the developing device 14 and a toner box 27 are integrally constituted. All the integrally constituted units are collectively replaced to be changed from a state indicated by (A) to a state of (B) in FIG. 2(*b*). In such a conventional structure, the problems already explained in the conventional problems occur.

In the embodiment of the invention, a part of a residual toner or the like remaining on the photosensitive member 11 after transfer is removed by the cleaner 30 (cleaning means). The remaining toner passes the cleaner 30 as a transfer residual toner while being left on the photosensitive member 11 without being cleaned (removed).

Thereafter, if necessary, the photosensitive member 11 is subjected to charge elimination processing and subjected to charging processing again to come into an image forming process in the next rotation.

The cleaner 30 is constituted as a unit including a cleaning unit 35 and a waste toner box (a waste toner storing unit) 34 that receives and stores a waste toner.

The cleaning unit 35 includes a brush roller (cleaning means) 31 that cleans the photosensitive member 11, a waste toner receiving roller 32 that receives the waste toner from the brush roller 31, and a cleaning blade 33 that scrapes off the waste toner received by the waste toner receiving roller 32.

The cleaner control unit 40 includes a brush roller control unit 41 that controls the brush roller 31 and a waste toner receiving roller control unit 42 that controls the waste toner receiving roller 32.

The image forming apparatus in this embodiment is characterized by cleaning a part of a toner in the cleaning unit 35 of the cleaner 30 and allowing the remaining toner to pass the cleaner 30 while being left on the photosensitive member 11 without being cleaned.

Specifically, first, a target value (a target value<an upper limit) of an amount of toner that is actually allowed to pass the cleaner 30 is set. In other words, in exposure, an amount of toner that does not cause a problem on an image even if the toner remains is calculated. For example, there is a method of judging, according to a pixel counter, what kind of image an image to be printed is and setting an amount of toner on the basis of the judgment.

Specifically, it is possible to set an amount of toner as described below.

1) In an image in which a halftone image is mixed, since it is highly likely that an image defect due to an exposure failure occurs when an amount of transfer residual toner is large, a target value of an amount of toner that is allowed to pass the cleaner is set low.
2) If an image includes only a character image, since a defect is less likely to occur on an image even if a slightly larger amount of toner is allowed to pass, a target value is set higher.
3) It is also possible to change an amount of toner according to a "print operation mode" selected by a user. For example, a target value of an amount of passing toner is set low in a high image quality mode and is set high in an energy saving mode or a character mode.

FIG. 3 shows an examination material for the setting. An experiment result obtained by examining how much toner passing the cleaning unit 35 does not cause a defect on an image is shown in FIG. 3(*a*). A memory chart is shown in FIG. 3(*b*).

A character image with a print area ratio of 6% is used as a print image. A memory chart shown in FIG. 3(*b*) is a chart in which a history is shown before a halftone section when an amount of cleaner passing toner (the cleaning unit) 30 is large. These images are visually checked to examine whether there is an image defect.

As cleaning means of the cleaning unit 35, the brush roller 31 is used. Thus, if there is a peripheral speed difference between the brush roller and the photosensitive member 11, a disturbance effect (described later) for a pattern is also included in the cleaning unit 35. A pattern actually disturbed passes the charger 12 and the exposing device 13 to be collected in the developing device 14.

According to a table in FIG. 3(*a*), when a toner with a particle diameter of 6.5 μm was used, an upper limit of an amount of toner passing the cleaning unit (the cleaner) was 6 $\mu g/cm^2$ in a high image quality mode (high gradation) and was 16 $\mu g/cm^2$ when a character was printed in a normal mode.

It is sent that, when a particle diameter of a toner is reduced, the upper limit tends to increase as a whole and a problem less easily occurs on an image. In this way, an upper limit of an amount of cleaner passing toner is different depending on a condition of an image. A target value is set to be equal to or lower than the upper limit according to a state of the image.

Subsequently, cleaning conditions for actually allowing a toner of a target value to pass are decided. As a method, for example, an amount of toner remaining on the photosensitive member 11 after cleaning may be detected by detecting means (a passing toner amount detecting unit or passing toner amount detecting means (e.g., the reflectance sensor (the non-contact sensor) 21) to perform feedback by the cleaner control unit 40. It is also possible that, as shown in FIG. 1(*b*), detecting means (e.g., the reflectance sensor 23) is provided before the cleaning means (the cleaning blade 31) of the cleaner 30 to detect an amount of residual (transfer residual) toner before passing the cleaner 30, estimate an amount of passing toner from the amount of the residual toner and the cleaner control unit 40 performs processing on the basis of a value obtained by the estimation.

The reflectance sensors 21 and 23 shown in FIGS. 1(*a*) and 1(*b*), respectively, are non-contact optical sensors that are, for example, set to be opposed to the photosensitive member 11 and detect reflected light of irradiated light to detect a reflectance. It is possible to measure an amount of toner remaining on the surface of the photosensitive member 11 after transfer using the reflectance sensor 23 and measure the amount of toner after passing the cleaner 30 using the reflectance sensor 21.

In an image measured by these reflectance sensors 21 and 23, for example, it is possible to use a patch image printed on the photosensitive member 11 for maintenance and adjustment of an image quality.

In the maintenance and adjustment of an image quality, a patch image with a predetermined reflection density is printed on the photosensitive member 11 separately from an image forming operation and a reflectance of the image is detected by the reflectance sensor 22 to perform control to maintain an image quality using a reflection density detected.

The maintenance and adjustment of an image quality is usually set to operate immediately after start of the image forming apparatus, during a predetermined continuous printing operation, or when the environment or the like fluctuates.

As an example in the embodiment of the invention, as shown in FIG. 1(*a*), it is possible to detect an amount of residual toner after passing the cleaner (the cleaning unit) and perform feedback to actual cleaning conditions using the patch image. In this method, since an amount of toner itself that has passed the cleaner is measured, relatively accurate control is possible.

As another method in this embodiment, as shown in FIG. 1(*b*), it is also possible to estimate an amount of cleaner passing toner from an amount of transfer residual toner. In this case, it is possible to set the reflectance sensor 23 at a post stage of transfer and before the cleaner to detect an amount of toner.

However, sensors exclusively used for detection of a reflectance are necessary as these sensors 21 and 23, resulting in an increase in cost of the entire apparatus. Thus, as a simpler method, it is conceivable to estimate an amount of transfer residual toner without providing a special sensor and perform feedback to cleaning conditions on the basis of the estimation. The reflectance sensor 21 is equivalent to the passing toner amount detecting unit or the passing toner amount detecting means of the invention.

For example, a type of the transfer member 18 to which an image is transferred from the photosensitive member 11 is detected and an approximate amount of transfer residual (amount of transfer residual toner) is estimated from the type. When it is attempted to directly transfer an image to a cardboard, an amount of transfer residual toner increases. The same problem occurs in non-uniform rough paper. Moreover, it is also possible to estimate an amount of transfer residual toner from an integrated number of prints of a developing agent or the photosensitive member 11. When the photosensitive member 11 is used for a long period of time, the surface of the photosensitive member 11 roughens and release properties fall. Thus, an amount of transfer residual toner increases. Thus, for example, a change in the surface of the photosensitive member may be estimated from a period of use of the photosensitive member 11 or roughening of the photosensitive member 11 may be optically detected to feed back a result of the estimation or the detection and estimate an amount of transfer residue.

When the developing agent deteriorates, an amount of charges of a toner becomes unstable and an amount of transfer residual toner increases. It is also possible to detect temperature and humidity and estimate an amount of transfer residual toner according to the temperature and the humidity. It is possible to attain a certain level of accuracy of estimation of an amount of transfer residual toner by combining the plural kinds of information.

On the basis of the amount of the transfer residual toner detected or estimated in this way, a correlation table between the amount of the transfer residual toner and cleaning conditions is created and calculation is performed in the image forming apparatus to perform feedback to the cleaning conditions. In this calculation, it is desirable to perform the calculation taking into account a change in cleaning performance due to the environment or a state of use, for example, fluctuation of the cleaning conditions due to a surface state of the photosensitive member.

Figure 4:
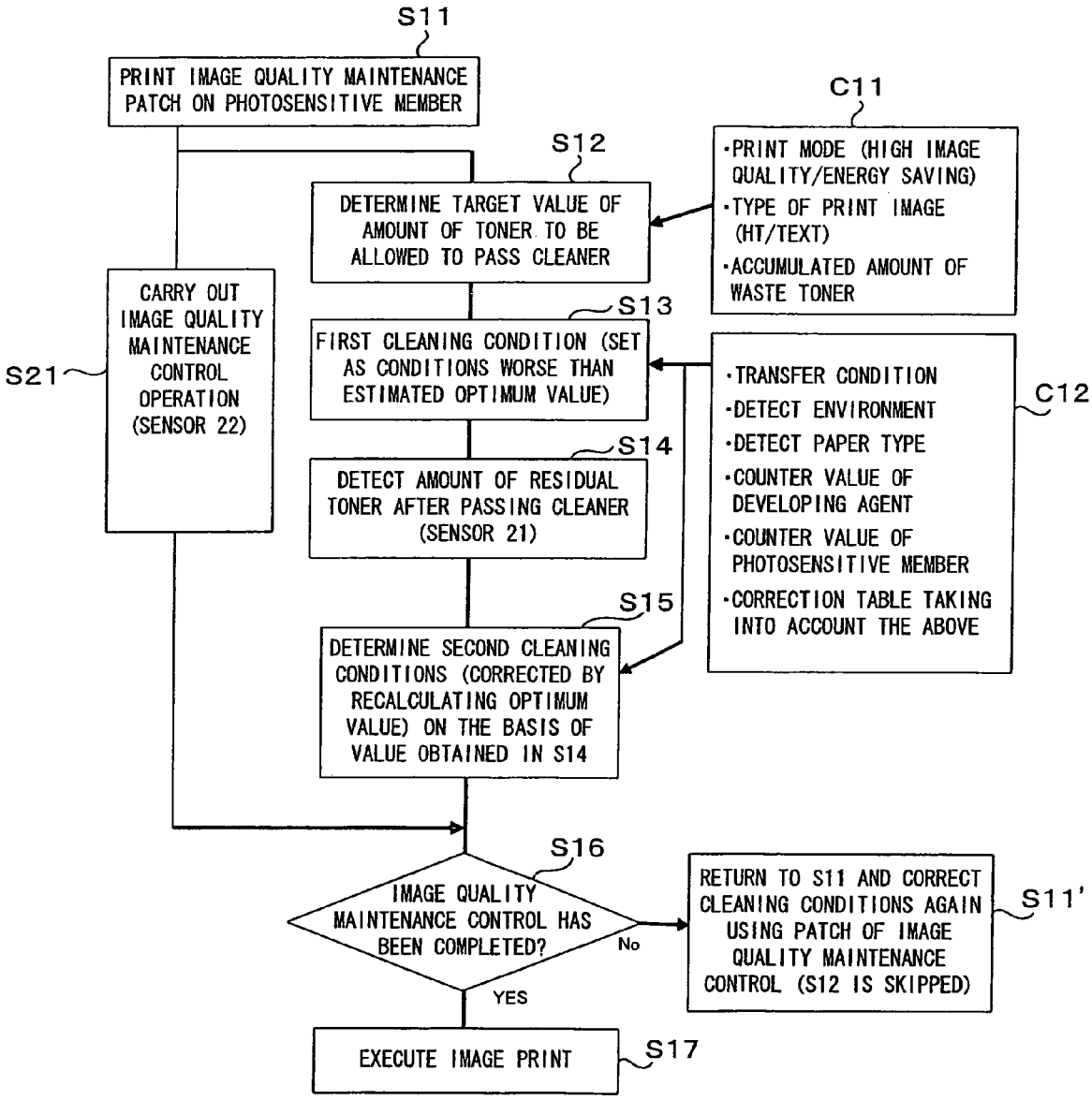
FIG. 4 is a flowchart showing an example of operations in the embodiment of the invention.

FIG. 4 is a flowchart showing an example of these kinds of control. The flowchart in FIG. 4 shows an example in which a patch image for image quality maintenance control (adjustment) is used.

When a patch image is printed on a photosensitive member (S11) and an operation of image quality maintenance control using the reflectance sensor 22 is carried out (S21), substantially at the same time, control based on this embodiment is started. First, a target value of an amount of toner to be allowed to pass the cleaning unit is determined from condition content C11 (S12).

Thereafter, cleaning conditions (first cleaning conditions) are determined from condition content C12. In that case, an amount of cleaner passing toner is set to be slightly larger than that in optimum cleaning conditions calculated (worse than an optimum value) (S13).

Thereafter, a reflectance of the photosensitive member 11 after passing the cleaner is measured by the reflectance sensor 21 (S14). The cleaning conditions are corrected by comparing the cleaning conditions with the condition content C12 on the basis of a value measured in step S14 to improve accuracy for a target amount of passing toner (S15). Thereafter, it is judged whether image quality maintenance control using the reflectance sensor 22, which is carried out in parallel, has been completed (S16).

When it is judged that the image quality maintenance control has been completed (S16, Y), the cleaning conditions determined in step S15 is determined as final cleaning conditions and image printing after that is executed (S17).

On the other hand, when it is judged that the image quality maintenance control has not been completed (S16, N), the control returns to the processing for printing a patch image (S11) (S11'). In this case, it is possible to perform correction of the cleaning conditions by the number of times of the print processing for a patch image. In the feedback of the plural times, it is unnecessary to repeatedly perform the calculation of a target amount of passing toner (S12) and it is possible to omit the calculation.

Such detection of an amount of toner passing the cleaner (the cleaning unit 35) and feedback of the amount of toner by the reflectance sensor 21 can be performed when an image quality maintenance operation is not performed.

For example, although an image quality maintenance patch is naturally used at the time of the image quality maintenance operation, during a usual print operation, it is possible to periodically apply feedback to cleaning conditions and perform more accurate control of an amount of toner after passing cleaning by detecting an amount of toner passing the cleaning unit of a usual print image.

As shown in C11, a target value of an amount of passing toner is calculated using a value of a table or the like based on whether a print mode is a high image quality mode or an energy saving mode or a type of a print image (e.g., a halftone (HT) or a text). As shown in C12, a transfer condition, the environment (temperature, humidity, etc.), a paper type, a counter value of the developing agent, and a counter value of the photosensitive member are obtained and the first cleaning conditions is set with respect to the target value with reference to a first table using all or any one of these values (a first set value is decided). Moreover, second cleaning conditions are set by correcting the first set value using the amount of the passing toner detected in the first cleaning conditions or with reference to a second table using at least any one of the various acquired values with respect to this amount of the passing toner (a second set value is decided).

When the reflectance sensor 23 that detects an amount of residual toner before passing the cleaner 30 is used, the cleaning conditions shown in step S14 only has to be obtained using a detection value of the amount of the residual toner.

Figure 5:
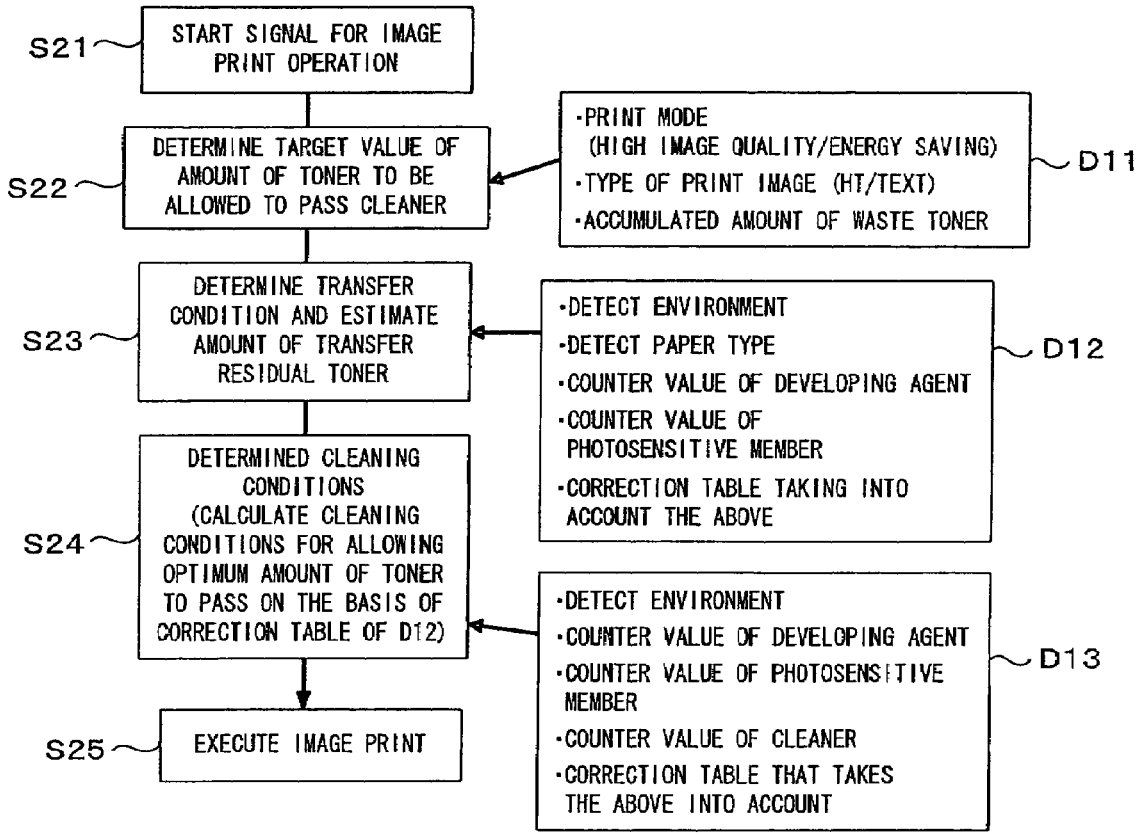
FIG. 5 is a flowchart showing another example of operations in the embodiment of the invention.

Another example of control will be explained with reference to a flowchart in FIG. 5.

This is an example in which an amount of transfer residual toner is estimated to control cleaning conditions. A reflectance sensor for detecting an amount of toner is not provided.

When an image print start signal is outputted (S21), a target value of an amount of toner to be allowed to pass the cleaning unit is determined on the basis of conditions D11 (a print mode, a type of a print image, an accumulated amount of waste toner, etc.) (S22). Transfer conditions are determined and, at the same time, estimation is performed for an amount of transfer residual toner from information such as environmental conditions including temperature and humidity, a type of a transfer medium (a paper type), or a developing agent counter or a life counter of the photosensitive member using a correction table mounted on a machine in advance (S23). On the basis of the transfer condition and the amount of the transfer residual toner and further appropriately taking into account conditions (the environment, a developing agent counter value, a photosensitive member counter, and a cleaner counter) D13, cleaning conditions are calculated using the correction table prepared in advance such that an amount of cleaning passing toner reaches the target value (S24). In this case, although an amount of toner passing the cleaning unit is not directly measured, it is possible to secure a certain degree of accuracy by estimating the amount of toner from the plural kinds of information.

As the brush roller 31 serving as the cleaning means shown in FIGS. 1(*a*) and 1(*b*), for example, a brush made of nylon or rayon and having resistance of 10e4 to 10e10Ω, thickness of 0.5 to 8 deniers, and a roller diameter of 8 to 30 mm can be used.

In the experiment, a brush made of nylon having thickness of 2 deniers, a diameter of 16 mm, and resistance of 1×10e7 Ω was used. A bias for collecting a transfer residual toner on the photosensitive member is applied to the brush roller 31. Usually, since the transfer residual toner is charged to a regular polarity (a negative polarity in this context), it is preferable to apply a bias of, for example, about +300 V in a direction opposite to the regular polarity.

Moreover, the waste toner receiving roller 32 serving as a conductive roller of ϕ14 is brought into contact with the brush roller 31 as toner removing means for receiving a toner removed from the photosensitive member by the brush. This roller 32 is driven to rotate at half speed of that of the brush roller 31 in the same direction as the brush roller 31. A voltage of +500 V is applied to the roller 32. It is desirable that a surface layer is provided on this conductive roller 32. As the surface layer, a Teflon or fluorine coating material having high releasing properties is effective. Thickness of the surface layer is preferably about 3 to 300 μm.

The simple cleaning blade 33 is further in contact with the waste toner receiving roller 32. A transfer residual toner is removed from the waste toner receiving roller 32 by the cleaning blade 33 and deposited in the waste toner box 34 serving as a waste toner accumulating unit that accumulates a waste toner removed.

In the cleaner of the conditions described above, for example, when the brush roller 31 is driven in the same direction as the photosensitive member 11 at equal speed or driven following the photosensitive member, the transfer residual toner on the photosensitive member 11 cannot be collected entirely.

Figure 6:
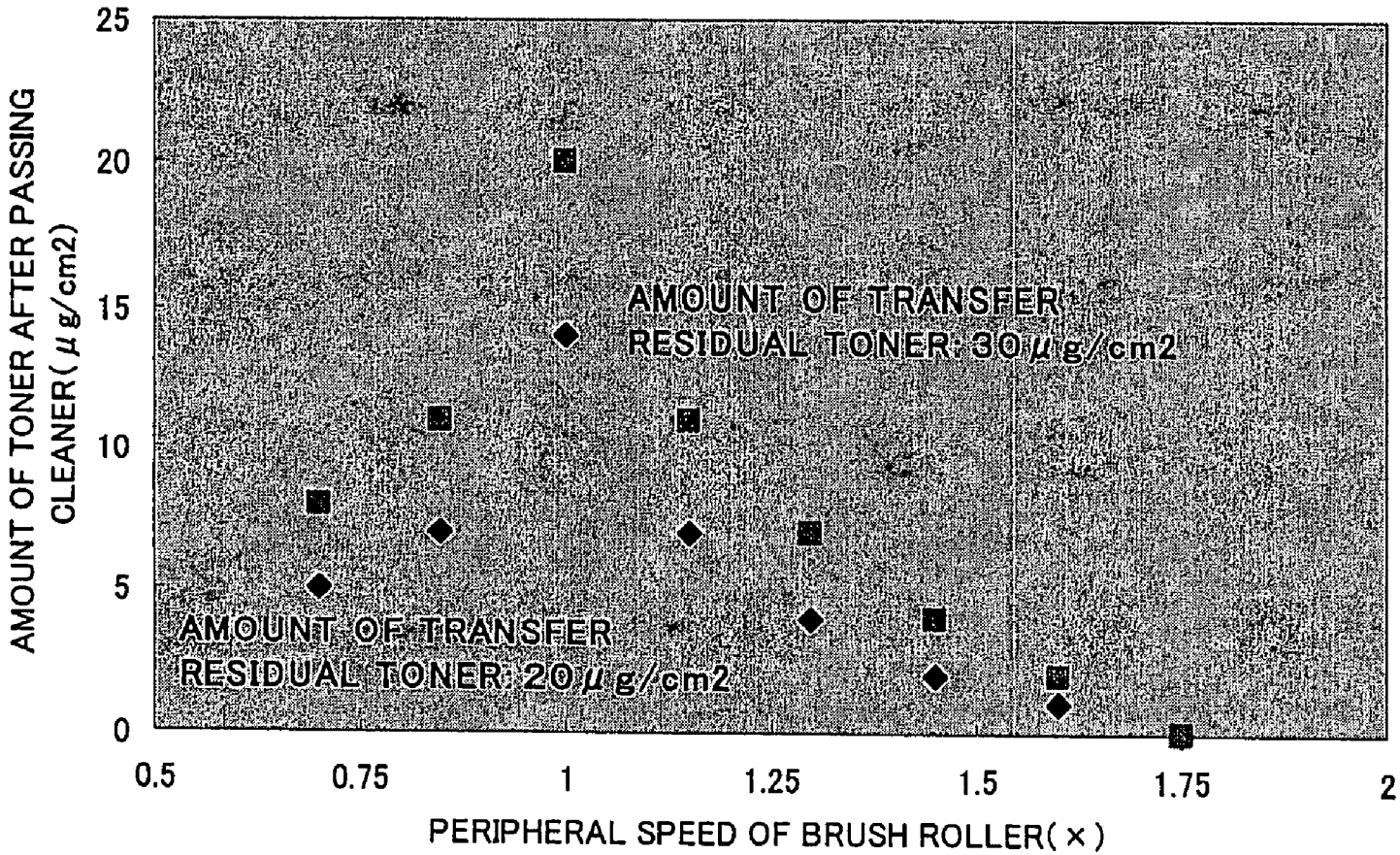
FIG. 6 is a graph showing a relation between peripheral speed of a brush roller and an amount of cleaner passing toner.

An experiment result is shown in FIG. 6. This experiment result is obtained by changing peripheral speed of the brush roller 31 with respect to the photosensitive member 11. It is seen that cleaning efficiency is low at a peripheral speed ratio of 1 and, when the peripheral speed ratio is shifted from 1, the cleaning efficiency is improved.

Figure 7:
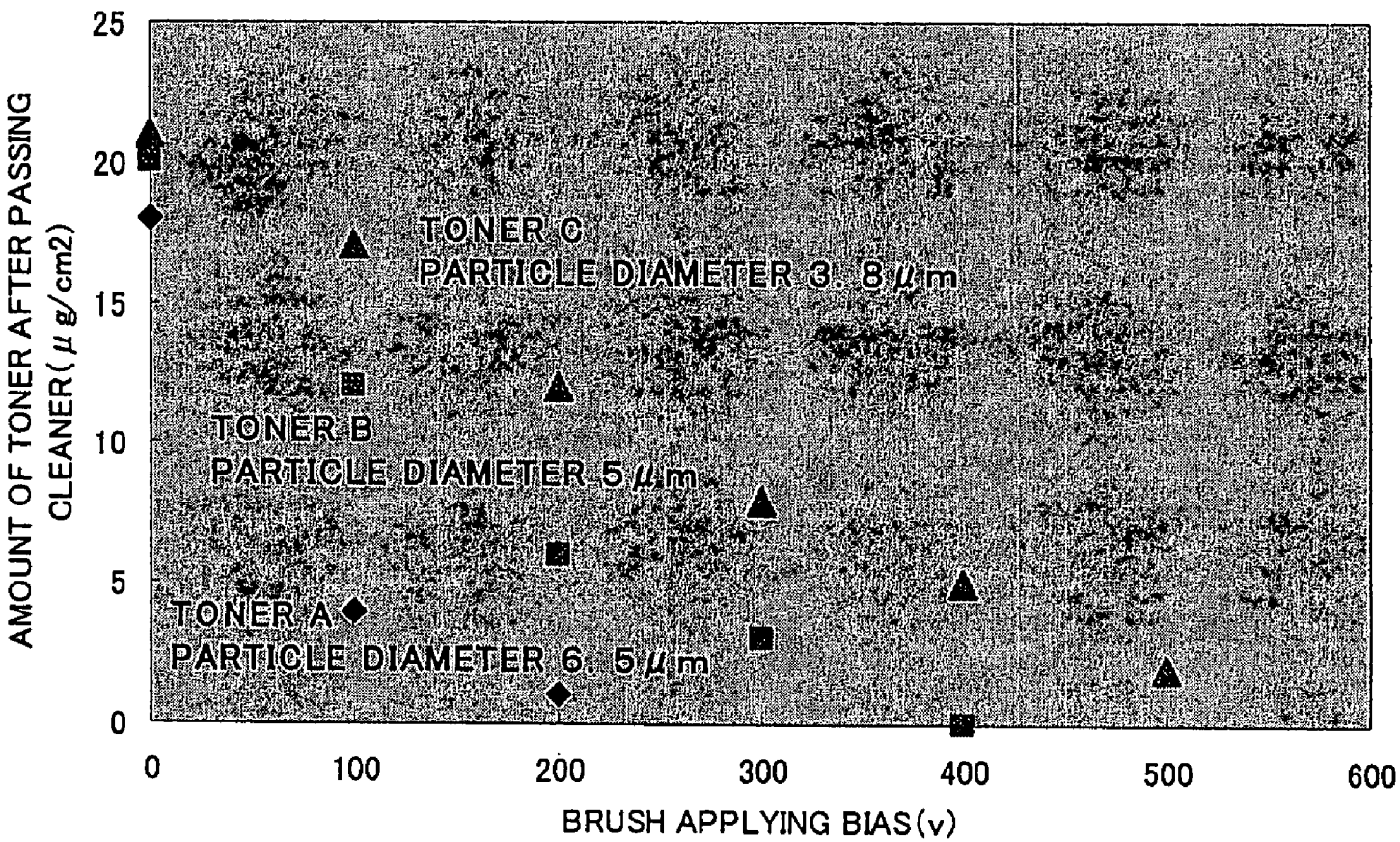
FIG. 7 is a graph showing a relation between a brush applying bias and an amount of cleaner passing toner.

FIG. 7 is a diagram showing a relation between a brush applying bias applied to the brush roller 31 and an amount of toner that has passed the cleaner 30. A surface potential of the photosensitive member 11 after transfer changes depending on transfer conditions and an image type such as a solid image or an HT (halftone) image. In this experiment, comparison of cleaning efficiency was performed solely for solid images. At a brush applying bias of 0 V, cleaning can hardly be performed. However, it is seen that, when the bias is raised gradually, the cleaning efficiency is improved.

When comparison of cleaning efficiency was performed using samples having different particle diameters of a toner, the cleaning efficiency was lower under the same bias condition as the toner particle diameter was smaller.

Judging from the usual conventional example, the fall of the cleaning efficiency is not preferable. However, it is seen that, according to a method of use like that in this embodiment, to the contrary, it is easy to control the cleaning efficiency, an inclination of the cleaning efficiency with respect to a bias is smaller and more stable when a particle diameter of a toner is smaller, and it is easy to handle the toner.

According to FIG. 7, it is seen that, with a toner with a particle diameter of 6.5 μm, a change (an inclination) of an amount of cleaner passing toner with respect to a brush applying bias is large and it is difficult to control the amount of the passing toner. On the other hand, it is seen that, with a toner with a particle diameter of 5 μm, the inclination is close to a straight line and it is easy to control the amount of the passing toner.

The cleaning means is not limited to the brush roller as in this embodiment. For example, it is also possible to adopt a method of controlling a contact condition in the conventional cleaning blade. In a cleaning blade using a conductive blade, a contact condition may be controlled by changing an applied bias. Moreover, the contact condition may be controlled by changing conditions of the blade cleaner and the brush roller using both the blade cleaner and the brush roller.

Figure 8B:
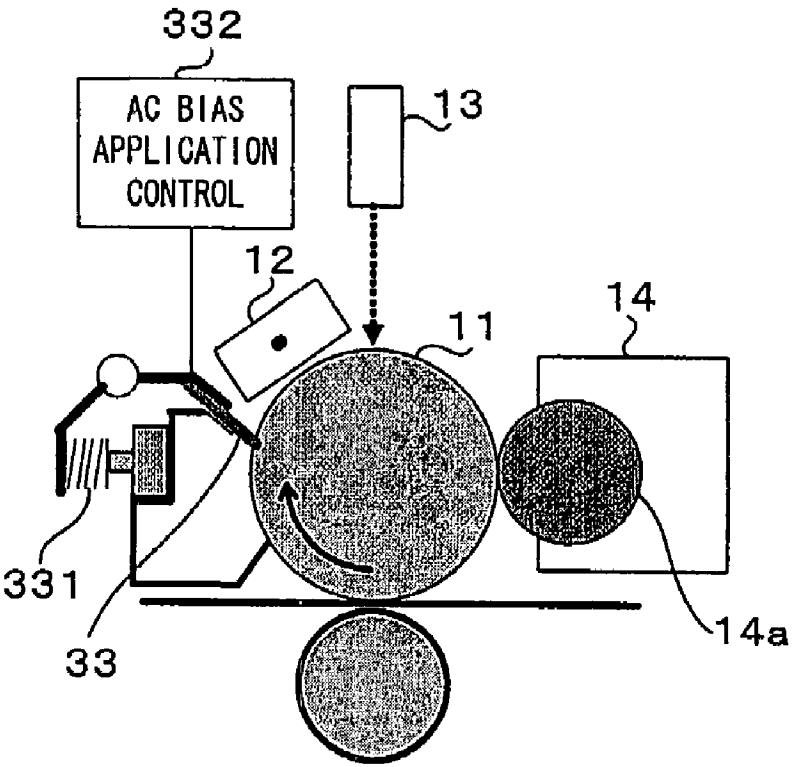
FIGS. 8(*a*) and 8(*b*) are diagrams showing an example of a cleaner control unit.
Figure 8A:
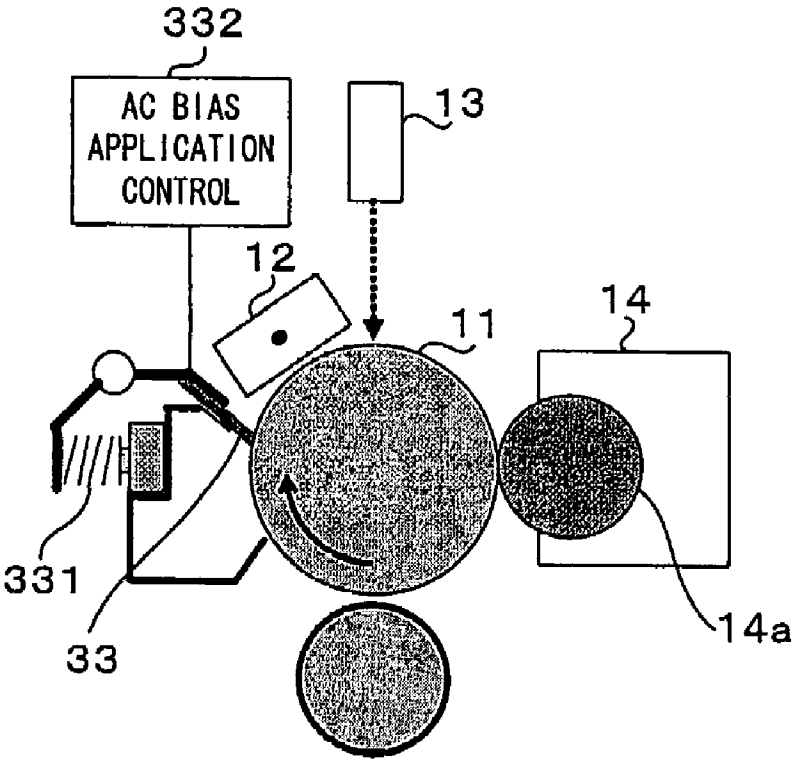

A form in the case in which cleaning means other than the brush roller is used as the cleaning means will be explained with reference to FIG. 8. FIGS. 8(*a*) and 8(*b*) are diagrams showing an example in which a contact pressure is changed in the cleaning blade 33. In general, when a contact pressure of the cleaning blade 33 is set high, cleaning efficiency is improved. However, an amount of shaving of the photosensitive member 11 increases and durability of the cleaner itself falls.

In this example, a blade load is controlled by a solenoid 331. It is also possible to control an amount of cleaning passing toner with such a method. A state shown in FIG. 8(*a*) is a state in which a load is low. A state shown in FIG. 8(*b*) is a state in which a load is low.

An example of means for changing the respective biases when the cleaning blade 33 is conductive is also shown in FIG. 8 as AC bias application control means 332. In the case of FIGS. 8(*a*) and 8(*b*), both the variable control of a contact pressure of the blade and the AC bias application control means 332 are shown. However, it goes without saying that only one of the variable control and the AC bias application control means 332 may be adopted.

Figure 9:
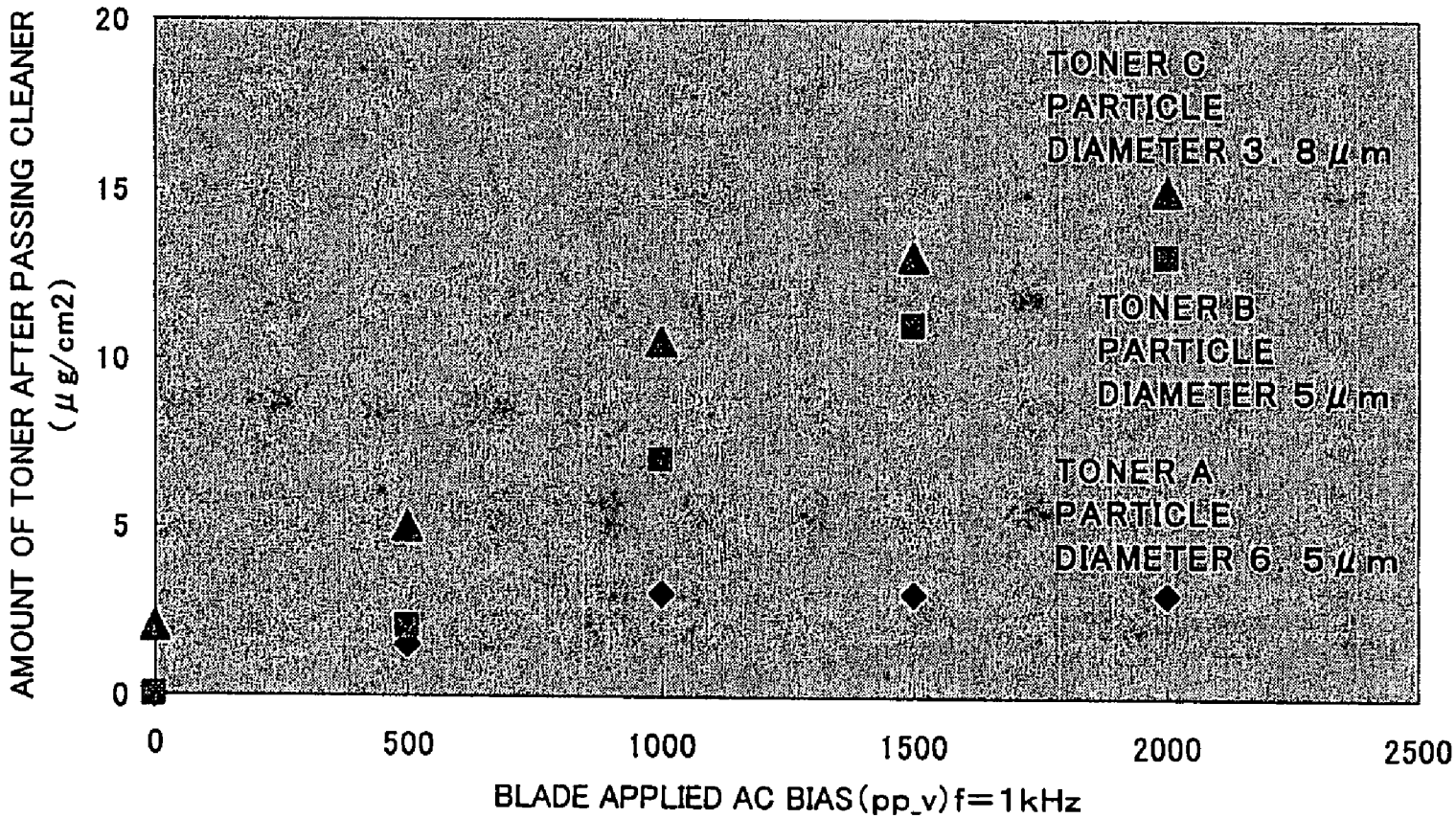
FIG. 9 is a graph showing a relation between a blade applying AC bias and an amount of cleaner passing toner.

An effect at the time when an AC bias is superimposed on the conductive blade 33 is shown in FIG. 9. When an AC bias is applied to vibrate the blade 33, it is possible to control an amount of toner passing the blade 33. In this case, the amount of the passing toner also changes depending on a particle diameter of the toner. When a particle diameter was 6.5 μm, a cleaning property was high with respect to an amount of transfer residual toner of 20 $\mu g/cm^2$ and, even if an AC of pp 2000 V was applied, only the toner of about 3 $\mu gg/cm^2$ passed. However, it is possible to allow a toner with a particle diameter of 5 μm to pass by about 14 $\mu g/cm^2$.

In the embodiment of the invention, from the viewpoint of controlling an amount of toner passing the cleaning unit, a toner with a smaller particle diameter is more easily controlled and advantageous.

In particular, when a toner has a particle diameter of 6.5 μm, an amount of cleaner passing toner is small and a range in which the amount of toner can be controlled is narrow. On the other hand, when a toner has a particle diameter of 5 μm, it is possible to cause the toner as much as about 14 $\mu g/cm^2$. It is seen that it is easy and effective to control an amount of toner passing the cleaning unit. Concerning a frequency of an AC bias, it is possible to use a frequency of about 100 Hz to 3 kHz. However, this depends on process speed and, when the frequency is set to high, a slipping effect of the toner is reduced and it is difficult to control an amount of passing toner. In a sense, this indicates that it is possible to control an amount of slipping toner by changing a frequency of the AC bias.

Moreover, in the cleaner (the cleaning means) used in the embodiment of the invention, it is possible to integrate the waste toner box 34 that accumulates a waste toner and the cleaning unit 35. In other words, it is possible to reduce a size of the waste toner box because an amount of waste toner is small. Thus, it is unnecessary to separately provide a large waste toner tank and it is possible to simplify a structure of the apparatus and reduce a size of the entire apparatus.

It is also preferable that a cleaner unit in which at least the cleaning unit 35 and the waste toner box 34 are integrated is made detachably attachable to the photosensitive member 11.

Figure 10B:
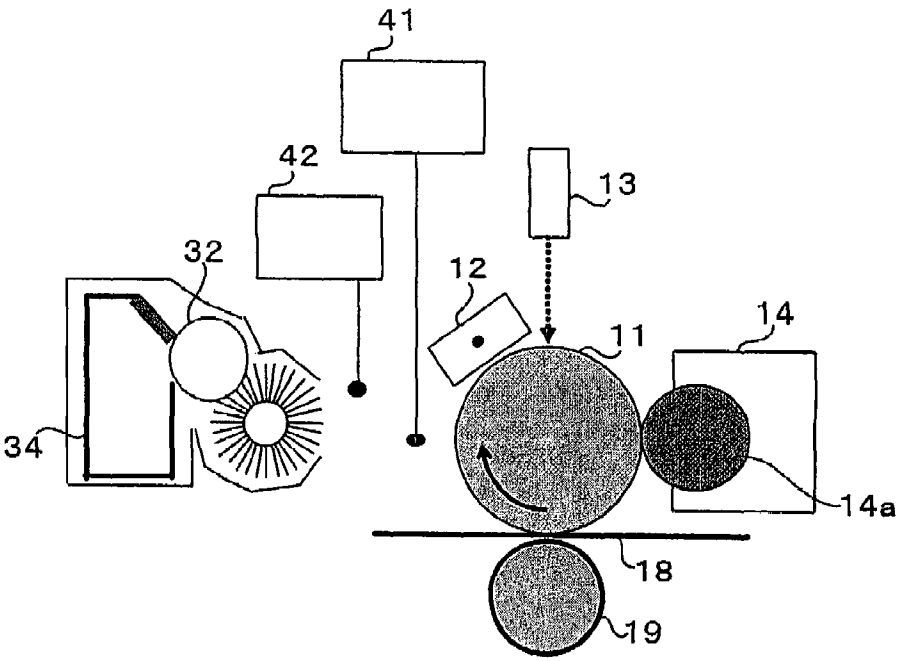
FIG. 10(*a*) is a schematic diagram showing a state at the time when a cleaner operates.
Figure 10A:
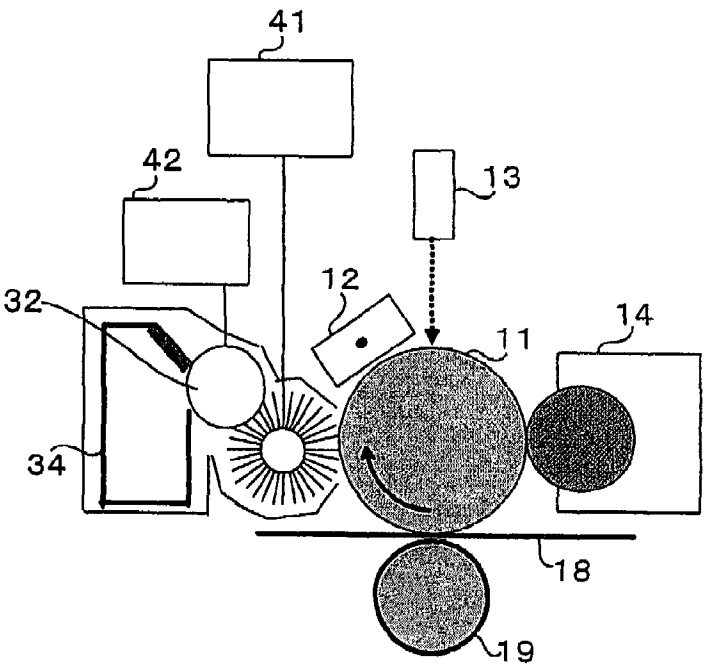

An example is shown in FIGS. 10(*a*) and 10(*b*). FIG. 10(*a*) shows a state at the time when the cleaner unit is mounted on the photosensitive member. FIG. 10(*b*) shows a state in which the cleaner unit is removed from the photosensitive member side. It is particularly effective to make the waste toner box 34 and the cleaning unit 35 detachably attachable to the photosensitive member 11 as the cleaner unit because it is possible to replace only the cleaner unit when the photosensitive member 11 having a long life is used. As such a photosensitive member, it is preferable to use, for example, α-Si.

In the developing device, usually, periodical replacement of a developing agent is essential in two-component development that uses a toner and a carrier. It is advisable to adopt a system for automatically replacing the carrier little by little without removing the developing device from the image forming apparatus.

Figure 11:
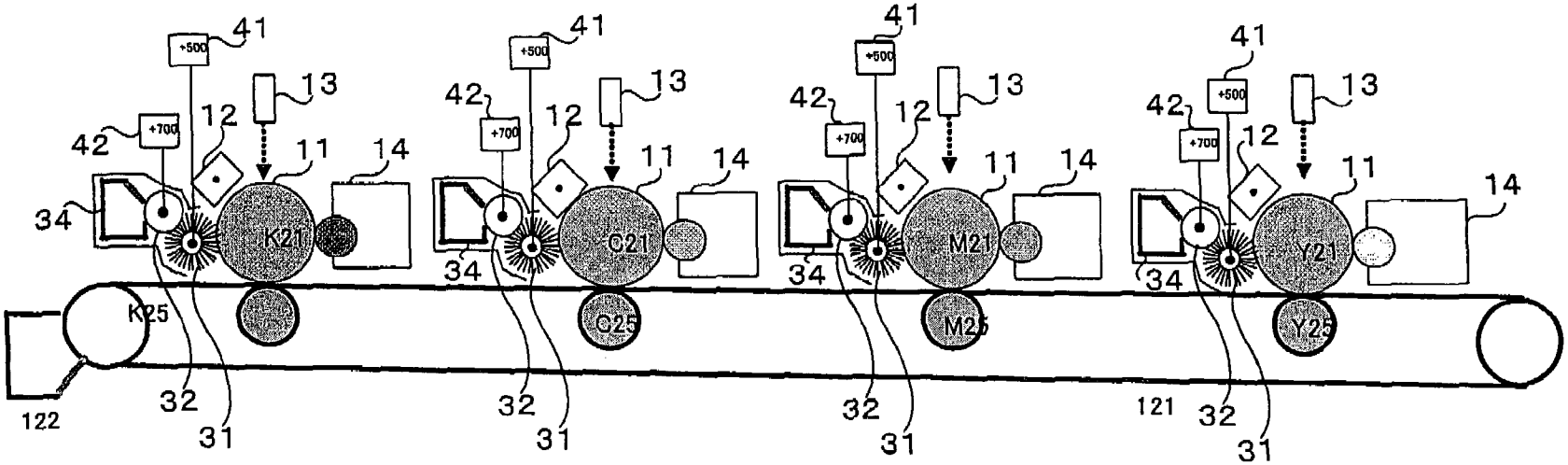
FIG. 11 is a schematic diagram showing a tandem structure of an image forming apparatus.

In particular, in the case of a tandem color machine shown in FIG. 11, a cleaner unit of an upstream station and a developing device of a downstream station easily interfere with each other. When the developing unit is reduced in size in a usual development system, a quantity of a developing agent decreases and a replacement cycle is reduced. However, it is possible to omit maintenance of the developing device and reduce a size of the developing device by adopting the small amount replacement system and, therefor, it is possible to increase a space for a waste toner box as much as possible. Thus, a synergistic effect can be expected in that a space for a waste toner storing unit (a waste toner box) is increased to extend a replacement cycle of the cleaner unit and, at the same time, make it unnecessary to replace the developing device.

Figure 12:
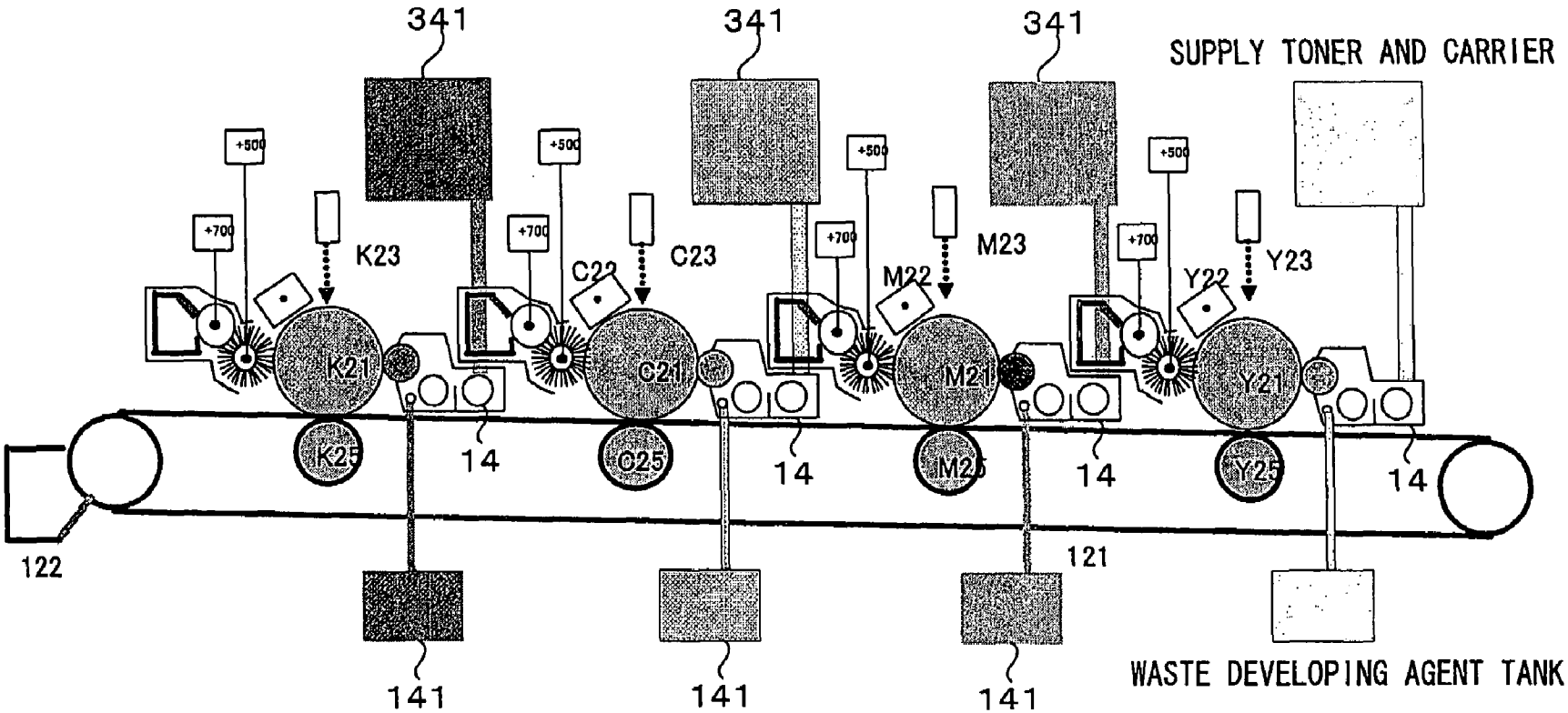
FIG. 12 is a schematic diagram showing a structure of an image forming apparatus in which efficiency of a space is realized by combining the cleaner and a developing device in the embodiment of the invention.
Figure 13B:
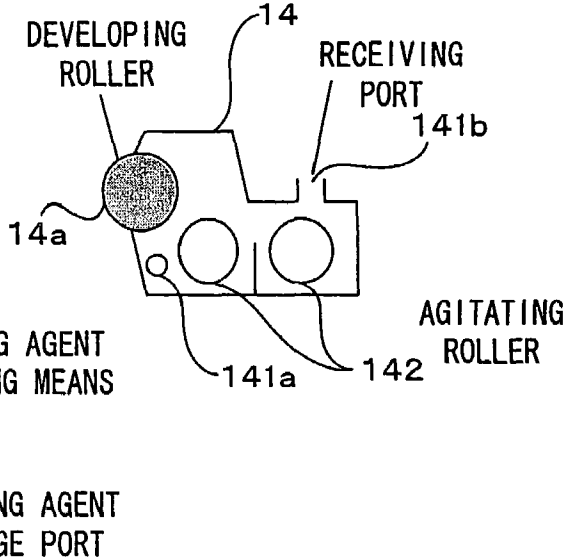
FIG. 13(*a*) is a plan view showing the developing device in the embodiment of the invention.
Figure 13A:
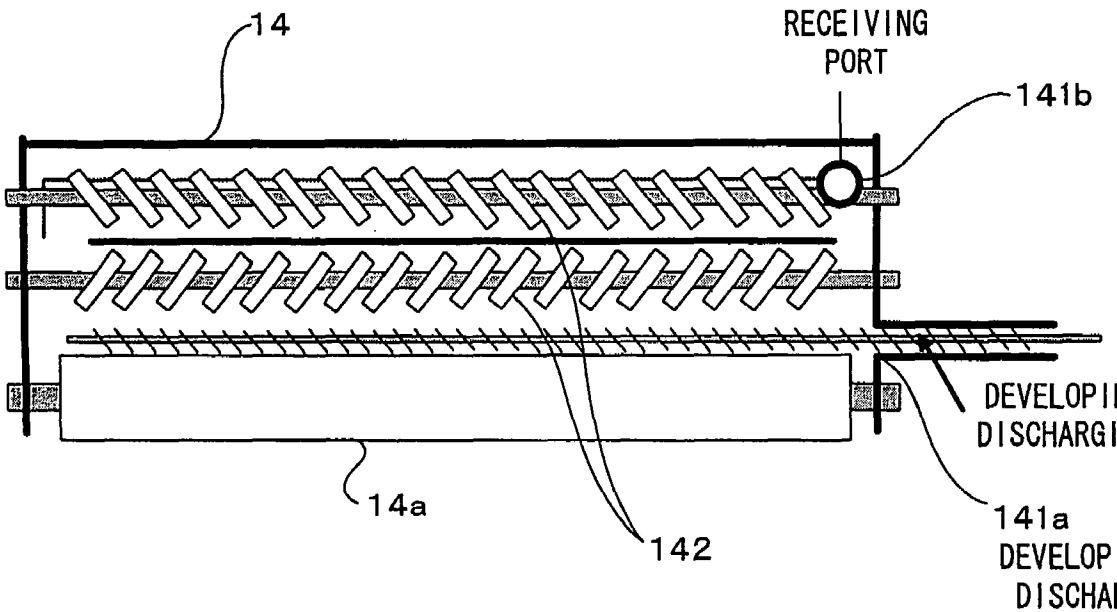

A structure of the entire tandem image forming apparatus is shown in FIG. 12. An example of the developing device is shown in FIG. 13. In FIG. 12, reference numeral 141 denotes a waste toner tank and 341 denotes a waste toner box increased in size.

As shown in FIGS. 12 and 13, the developing device 14 has a discharge port 141*a* for a developing agent. The developing device 14 automatically discharges the developing agent from the discharge port 141*a* gradually and sends the developing agent to the waste toner tank (toner discharging means) 141.

Concerning control of a discharge amount, a discharge operation may be controlled by, for example, rotation of an auger 142 shown in FIG. 13 serving as discharging means exclusively used for the developing agent. Alternatively, a so-called overflow system in which, when an amount of the developing agent in the developing device 14 increases to reach height equal to or higher than fixed height, the developing agent overflows to be discharged may be adopted.

As supply of the developing agent, a small quantity of a carrier may be mixed in a not-shown toner tank together with a toner and gradually supplied from a receiving portion 141*b* together with the toner according to consumption of the toner. Alternatively, the toner and the carrier may be controlled separately and inputted to the developing device.

In any case, by using such a developing device, replacement work for the developing agent by detachment of the developing device from the apparatus is made unnecessary. A mechanical life of the developing device in the two-component development is extremely long at about 300,000 to 2,000,000 pieces. Thus, for the user, there is no apparent replacement work for the developing device.

As described above, it is almost unnecessary to remove the photosensitive member 11 and the developing device 14 from the image forming apparatus. Moreover, it is possible to constitute the charger 13 integrally with, for example, the cleaner unit. Consequently, the user only has to perform maintenance of replacement of the toner tank and the cleaner unit (the cartridge including the charger) as described above.

In this way, since an amount of waste toner can be reduced in the embodiment of the invention, it is possible to expect a further effect concerning maintainability according to the combinations described above.

However, since a waste toner cannot be surely reduced to zero, naturally, as a target value of an amount of toner to be allowed to pass the cleaner is larger, the cleaner unit can be further reduced in size. If an amount of toner to be allowed to pass the cleaner unit is small, the unit is increased in size or a replacement cycle of the unit is reduced.

There is an upper limit of an amount of toner that can pass the cleaner because of a balance between the amount of toner and an image quality. Thus, it is advantageous that an amount of transfer residual toner is small. Moreover, even if the same amount of toner is a waste toner, a "volume" of the waste toner is small. Paying attention to reduction in the amount of transfer residual toner, it is important that transfer efficiency is high. For example, when the contact transfer system is adopted, transfer efficiency is high compared with that of corona transfer and the like.

Moreover, since a polarity of the transfer residual toner less easily fluctuates, occurrence of an inversely charged toner is little, bias cleaning is stable, and it is easy to control an amount of passing toner.

Concerning the small volume of the deposited toner, a small toner particle diameter is important. When a particle diameter is small, even if an amount of toner is the same, a "volume" of the toner is small. When a particle diameter of a toner is small, as explained already, an amount of toner to be allowed to pass the cleaning unit can be set increased. Thus, it is advantageous to apply the toner to the embodiment of the invention.

Moreover, when a toner is spherical, a "volume" of a waste toner is smaller. In this way, in the embodiment of the invention, a synergistic effect is obtained when the contact transfer system, the small particle diameter toner, and the spherical toner are combined.

As another embodiment of the invention, it is also possible that an amount of waste toner accumulated in the waste toner box 34 is detected and, when the amount of waste toner increases to be equal to or more than a fixed amount, cleaning conditions are changed. In this embodiment, for example, while a waste toner replacement sign is sent to the user, a print operation is possible. It is possible to prevent the waste toner from overflowing or clogging to break the apparatus.

However, in this case, since control is performed to increase an amount of cleaner passing toner without increasing the waste toner, an image quality is deteriorated and, for example, soil occurs in a character chart or memory occurs in a memory chart.

Figure 14:
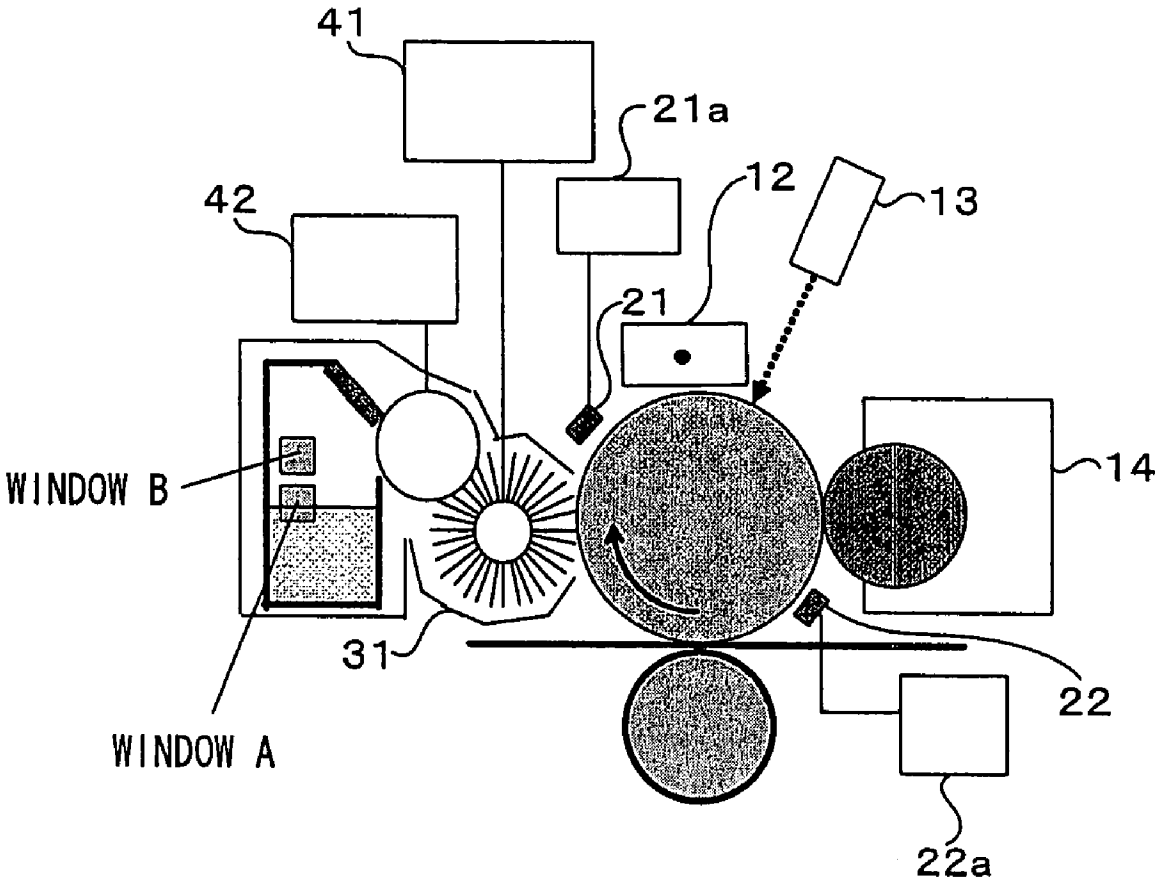
FIG. 14 is a diagram showing a modification of the cleaner in the embodiment of the invention.

For example, as shown in FIG. 14, a window is provided in the waste toner box 14 and a "volume" of waste toner is optically detected by an optical sensor including a light emitting unit and a light receiving unit provided on the image forming apparatus side. The "window" and the optical sensor constitute the waste toner amount detecting unit of the invention. When the volume reaches a "volume" equal to or larger than a fixed volume (a window A), a target value of an amount of cleaner passing toner is set close to an upper limit value that does not cause a problem in an image. For example, in the figure, when a waste toner is accumulated exceeding a window B, an amount of cleaner passing toner is set higher than the upper limit value that does not cause a problem in an image.

Figure 15:
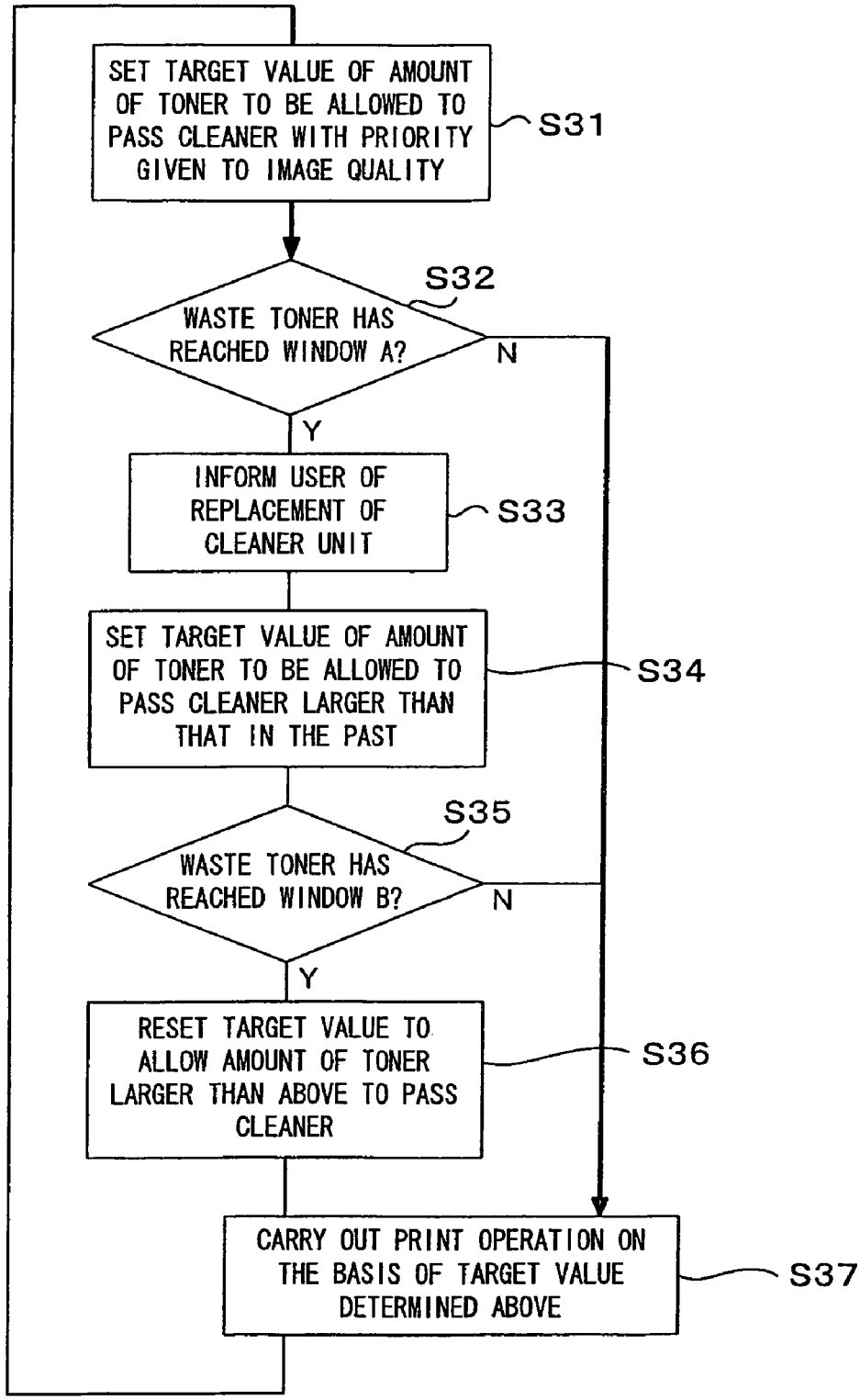
FIG. 15 is a flowchart showing a cleaner control operation using the cleaner shown in FIG. 14.

In this form, for example, it is possible to perform the setting on the basis of a flow shown in FIG. 15. First, a target value of an amount of toner to be caused to pass the cleaner is set as described above with priority given to an image quality (S31). It is judged whether a waste toner has reached the first window A provided at predetermined height (S32). When the waste toner has reached the first window A (S32, Y), the user is informed of replacement of the cleaner unit (S33). At the same time, a target value of an amount of toner to be allowed to pass the cleaner 30 is set larger than that set earlier (S34).

Subsequently, it is judged that whether the waste toner has reached the second window B provided in a position higher than the first window A (S35). When it is judged that the waste toner has reached this position (S35, Y), a target value of an amount of toner to be allowed to pass the cleaner is set larger (S36).

The target values set in this way are used for a print operation. By increasing an amount of cleaner passing toner stepwise according to the increase of the waste toner in this way, even if an image quality is deteriorated slightly, it is possible to delay a period for replacement of the cleaner unit to time convenient for the user as a tolerance of image formation and prevent down time from occurring.

EXAMPLES

An experiment for checking an effect in the case in which the embodiment of the invention was carried out was attempted.

Three kinds of toners with average particle diameters of 6.5 μm, 5 μm, and 3.8 μm were used in association with a transfer residual toner of about 25 μg/cm$^2$. Polyester was used as resin of the toner, the toner was created by the grinding method and classified, and particle diameters were adjusted using substantially the same material.

The brush roller 31 already explained was used as the cleaning means. An amount of cleaner passing toner was adjusted by changing a peripheral speed difference. In that case, in order to determine cleaning conditions, an actual amount of toner on the photosensitive member 11 that has passed the cleaner was measured by a reflectance meter.

(A) For example, in the case of a toner with a particle diameter of 6.5 μm, an upper limit of an amount of passing toner for not causing an image defect (FIG. 3(*a*)) is 16 μg/cm$^2$ in a character chart and 6 μg/cm$^2$ in a high gradation mode.

Assuming that a target value of an amount of passing toner was 0.8 times as high as the upper limit values taking into account variation and fluctuation, a target value was set to 12.8 μg/cm$^2$ in the character mode and set to 4.8 μg/cm$^2$ in the high gradation mode.

In this case, peripheral speed of the brush was increased to about 1.03 times and 1.22 times as high as that of the photosensitive member.

(B) In the case of a toner with a particle diameter of 5 μm, an upper limit value was 19 μg/cm$^2$ in the character chart and was 7 μg/cm$^2$ in the high gradation mode. Assuming that a target value of an amount of passing toner was 0.8 times as high as the upper limit values, a target value was set to 15.2 μg/cm$^2$ in the character mode and set to 5.6 μ/cm$^2$ in the high gradation mode. In this case, peripheral speed of the brush was increased to about 1.05 times and 1.35 times as high as that of the photosensitive member.

(C) In the case of a toner with a particle diameter of 3.8 μm, an upper limit value was 22 μg/cm$^2$ in the character chart and was 8 μg/cm$^2$ in the high gradation mode. Assuming that a target value of an amount of passing toner was 0.8 times as large as the upper limit values, a target value was set to 17.6 μg/cm$^2$ in the character mode and set to 6.4 g in the high gradation mode. In this case, peripheral speed of the brush was about 1.07 times and 1.5 times as high as that of the photosensitive member.

As described above, peripheral speed of the brush roller was changed in the respective image quality mode. In the character mode, 80 sheets of a character chart with a print area ratio of 10% were printed and, then, 20 sheets of a memory chart were printed in the high image quality mode. This printing was repeated by two cycles to perform a print test for 200 sheets.

Thereafter, measurement of an amount of toner passing the cleaning unit was performed again and target values were set again to change peripheral speed of the brush roller, and, then, the same printing was performed for two cycles. This is repeated five times to perform a print test for 1,000 sheets in total. A test was also carried out under a condition that resetting of cleaning conditions, which was performed for ever 200 sheets, was not performed and setting of an amount of toner passing the cleaning unit was carried out only in an initial period.

In the case of these print tests, images were extracted every 10 sheets and it was checked after the tests whether image defects due to soil and an exposure failure occurred in images. After printing 1,000 sheets, an amount of toner accumulated in the waste toner storing unit was measured. FIG. 16 shows results of these tests.

In FIG. 16, as a comparative example, a test was performed under a condition that peripheral speed of the brush roller was set 1.75 times as high as the photosensitive member and a transfer residual toner can be cleaned almost 100%. There was no problem of an image quality over 1,000 sheets of images. However, an amount of waste toner was large at about 1800 mg.

Subsequently, an experiment (1) was performed. A toner with a particle diameter of 6.5 μm was used, adjustment of cleaning conditions was performed at the start time, and readjustment was not carried out later. Before reaching 400 sheets in total, soil slightly occurred in a character image. When printing exceeded 500 sheets, an image defect due to memory occurred even in a memory chart of the high image quality mode. Although levels of both the soil and the image defect were not severe, since the image defect occurred without doubt, it is considered that an amount of toner passing the cleaning unit is unstable.

In an experiment (2), feedback was applied to cleaning conditions every 200 sheets under the same conditions. According to this experiment, an image defect did not occur over 1,000 sheets and an amount of cleaning passing toner could be stabilized by periodically applying feedback to cleaning conditions. Moreover, an amount of waste toner was 970 mg when 1,000 sheets were printed. This is almost half as many as that in the comparative example.

In an experiment (3), an upper limit value of a target value of an amount of toner passing the cleaning unit, which determined cleaning conditions, was changed from 0.8 times to 0.7 times. It is seen that, by changing the upper limit value in this way, although an amount of waste toner slightly increases (1100 mg) compared with the experiment (2), the amount of waste toner is sufficiently small compared with that in the comparative example and it is possible to maintain a high image quality even if feedback of conditions is not carried out frequently.

In an experiment (4), a result was obtained by using a toner with a particle diameter of 5 μm. When the experiment was performed using the toner with the particle diameter of 5 μm in the same setting as the experiment 1 at the time when the particle diameter was 6.5 μm, an image defect did not occur over 1,000 sheets even if feedback was not applied ever 200 sheets because of an effect of the reduced toner particle diameter. Since a target value of an amount of toner passing the cleaning unit could be set high, an amount of waste toner was 860 mg/1,000 sheets, which was small compared with those in the experiments (1) and (2).

In an experiment (5), it was attempted to reduce a margin for an image quality by setting a target value of an amount of toner passing the cleaning unit to 0.85 times with respect to an upper limit value and further reduce an amount of waste toner. In this case, soil occurred in a character image when printing exceeded 300 sheets.

In an experiment (6), feedback of cleaning conditions was frequently applied every 200 sheets. When the feedback of cleaning conditions was frequently applied every 200 sheets in this way, an image defect did not occur over 1,000 sheets even if a target value was set 0.85 times as high as an upper limit value, an amount of waste toner was 800 mg/1,000 sheets as intended, and the amount of waste toner could be further reduced.

Similarly, in experiments (7) to (9), experiment results concerning a toner with a particle diameter of 3.8 μm were obtained. It is seen that, when a toner has a particle diameter of 3.8 μm, when a target value is a scaling factor is 0.85, only feedback in an initial period has to be performed and, when a scaling factor is increased to 0.9, although feedback is frequently required, as indicated by the experiment (9), an amount of waste toner can be reduced substantially without causing an image defect. In other words, a smaller particle diameter of a toner is more advantageous and it is possible to reduce the amount of waste toner while maintaining a high image quality. Finally, in the experiment (9), the waste toner was 590 mg/1,000 sheets and could be reduced to ⅓ compared with the conventional comparative example.

FIG. 17 shows an experiment result obtained in the same manner as the above description by changing a transfer system.

Since an amount of toner that can pass the cleaner is fixed, from the viewpoint of reducing an amount of waste toner, it is important that an amount of transfer residual toner is small. However, in corona transfer, it is difficult to reduce a transfer residual toner to 25 $\mu g/cm^2$.

In an experiment (10) shown in FIG. 17, in an amount of developed toner same as that in the roller transfer, since an amount of transfer residual toner was 35 $\mu g/cm^2$, cleaning conditions were set to increase cleaning efficiency (increase peripheral speed of the brush), and an amount of toner to be allowed to pass the cleaner was adjusted to that in the case in which the roller transfer was used (comparison with the experiment (4)).

As a result, naturally, the amount of waste toner increased. Whereas the amount of waste toner was 860 mg/1,000 sheets in the experiment 4, the amount of waste toner was 1550 mg/1,000 sheets in the experiment (10). Memory occurred in a memory chart when about 300 sheets were printed.

Subsequently, in an experiment (11), even when the corona transfer system is used, an amount of transfer residual toner was reduced to 25 $\mu g/cm^2$ by reducing an amount of developed toner and only a difference due to a transfer system was checked under the same conditions as the experiment (4) in FIG. 16. As a result, an amount of waste toner was substantially the same value as that in the experiment (4).

However, in the case of the roller transfer, a satisfactory image quality was obtained over 1,000 sheets if cleaning conditions were adjusted once in the initial period. However, when the corona transfer was used, memory occurred in a memory chart when about 700 sheets were printed and, after that, soil or the like occurred in characters.

In other words, it is seen that, even if an amount of transfer residual toner is set the same, a state of a transfer residual toner is not stable in the corona transfer system compared with the contact transfer system of a roller or the like and an image defect tends to occur. In an experiment (12), in the corona transfer, cleaning conditions were fed back every 200 sheets. It is seen that, although stability is lower than that in the roller transfer, the effect of this embodiment is also obtained in the corona transfer by frequently applying feedback.

By controlling the cleaning conditions in this way, it is possible to reduce an amount of waste toner while maintaining a high image quality by allowing only an amount of toner not causing a problem on an image to pass the cleaner. This makes it possible to reduce a size of the apparatus. When the cleaner and the waste toner storing unit are integrated to allow the user to replace the cleaner and the waste toner storing unit, the user can easily perform waste toner disposal.

As explained above by citing the example, in this embodiment, a part of a transfer residual toner is cleaned and an amount of toner in a range not hindering the next image formation is left on the photosensitive member (allowed to pass the photosensitive member) rather than cleaning the transfer residual toner entirely.

An example of such partial collection of a transfer residual toner is disclosed in JP-A-9-251264 as described above. However, an object of JP-A-9-251264 is removal of an inversely charged toner using a bias. Deterioration in an image quality in the case in which an amount of transfer residual toner is large, which is the problem of the cleanerless process, cannot be solved only by the removal of an inversely charged toner. In other words, there is a limit in realizing both the removal of an inversely charged toner and a high image quality.

Thus, in the embodiment of the invention, means for detecting or estimating an amount of cleaning passing toner and controlling cleaning conditions to reduce the amount of cleaning passing toner to be equal to or smaller than an upper limit value not causing a problem on an image is provided. This makes it possible to minimize an amount of waste toner while maintaining a high image quality.

Since 100% cleaning efficiency is not required as a condition from the beginning, it is possible to select conditions and a material of the cleaning member from a range wider than that in the past. Thus, it is possible to improve durability of the cleaning means and reduce cost. As a synergistic effect, it is possible to relax a contact condition of the cleaning member with the photosensitive member. Thus, it is possible to hold down an amount of filming or film shaving of the photosensitive member compared with the conventional conditions and contribute to improvement of durability of the photosensitive member.

In this embodiment, since it is possible to reduce an amount of waste toner, it is possible to integrate the cleaning means and the waste toner storing unit as one unit to make it possible to freely detach the unit from the photosensitive member. If there is a large amount of waste toner as in the past, the waste toner storing unit is increased in size or the waste toner storing unit has to be replaced frequently. However, when this embodiment is applied, the waste toner storing unit is not increased in size, which is advantageous for a reduction in size of the entire apparatus. Concerning deterioration in an image quality that occurs in the cleanerless process, since only an amount of toner not causing the problem such as an exposure failure is allowed to pass the cleaner, a high image quality is obtained. Paper powder and a toner with low performance that could not be transferred are removed by the cleaner, although not completely. Thus, it is possible to maintain a high image quality over a long period of time.

The embodiment of the invention is effective, in particular, for a toner with a small particle diameter. This is because an influence causing a failure is reduced at the time of exposure compared with a toner with a large diameter in the past. When a particle diameter is reduced, it is possible to form a high quality image without performing cleaning sufficiently.

On the other hand, when a particle diameter is reduced in size, since conditions for the cleaning means are made strict to perform cleaning with 100% cleaning efficiency, it is difficult to realize both durability and low cost. However, a purpose of reducing a particle diameter of a toner is improvement of an image quality in most cases. Only with the cleanerless process or removal of only an inversely charged toner in the conventional example, it is difficult to maintain a high image quality if an amount of toner on the photosensitive member is large. It is extremely effective to apply the invention in such a case.

The invention claimed is:

1. An image forming apparatus comprising:

an image bearing member on which an electrostatic latent image formed on a surface thereof is visualized by a supplied toner to form a toner image;

a cleaner configured to remove a part of a toner remaining on the image bearing member and allows the remainder to pass as a passing toner, after a toner image formed on a surface of the image bearing member is transferred to a transfer member;

a passing toner amount detecting unit configured to detect or estimate an amount of a passing toner that passes the cleaner; and a cleaner control unit configured to set, on the basis of an amount of passing toner detected by the passing toner amount detecting unit, a target value of the amount of the passing toner and control a cleaning operation by the cleaner.

2. An image forming apparatus according to claim 1, wherein the passing toner amount detecting unit detects the amount of passing toner by measuring an amount of toner remaining on the image bearing member after the cleaning operation by the cleaner is performed after the transfer.

3. An image forming apparatus according to claim 1, wherein the passing toner amount detecting unit estimates the amount of passing toner by measuring an amount of toner remaining on the image bearing member before the cleaning operation by the cleaner is performed after the transfer.

4. An image forming apparatus according to claim 1, wherein a target value of the amount of passing toner is set to be equal to or lower than a set target value set in advance to be in a range not causing an image defect in a following toner image forming process.

5. An image forming apparatus according to claim 1, wherein the passing toner amount detecting unit is constituted by a non-contact sensor provided to be opposed to the image bearing member.

6. An image forming apparatus according to claim 1, wherein the passing toner that has passed the cleaner is collected by a developing device configured to supply a toner to the image bearing member.

7. An image forming apparatus according to claim 1, wherein the cleaner is constituted as a unit in which a waste toner storing unit configured to store a toner removed by the cleaner is integrated.

8. An image forming apparatus according to claim 7, wherein the unit is provided to be detachably attachable to the image bearing member.

9. An image forming apparatus according to claim 1, wherein the cleaner includes a waste toner storing unit configured to store a toner removed by the cleaner and includes a waste toner amount detecting unit configured to detect an amount of waste toner stored in the waste toner storing unit, and the cleaner control unit changes the target value on the basis of a waste toner amount detected by the waste toner amount detecting unit.

10. An image forming apparatus according to claim 1, wherein the cleaner control unit sets cleaning conditions such that a control result approaches the target value stepwise.

11. An image forming apparatus according to claim 1, wherein a particle diameter equal to or smaller than 5 μm is used as a particle diameter of the toner.

12. An image forming apparatus according to claim 1, wherein an image visualized on the image bearing member is transferred onto the transfer member by bringing a transferring member into contact with the image bearing member via the transfer member.

13. An image forming apparatus according to claim 1, wherein a developing device configured to supply a toner to the image bearing member includes discharging means for the toner and supplying means for the toner.

14. An image forming apparatus according to claim 1, wherein the image bearing member is constituted by a photosensitive member made of a material containing A-Si.

15. An image forming apparatus according to claim 1, wherein the cleaner is constituted using a brush roller, and the cleaner control unit controls a brush applying bias of the brush roller.

16. An image forming apparatus according to claim 1, wherein the cleaner is constituted using a cleaning blade, and the cleaner control unit controls an AC bias of the blade.

17. An image forming apparatus according to claim 1, wherein the cleaner is constituted using a cleaning blade, and the cleaner control unit controls a pressing force of the blade against the image bearing member.

18. An image forming apparatus comprising:

image bearing means on which an electrostatic latent image formed on a surface thereof is visualized by a supplied toner to form a toner image;

cleaner means for removing a part of a toner remaining on the image bearing means and allowing the remainder of the toner not removed to pass as a passing toner, after a toner image formed on a surface of the image bearing means is transferred to a transfer member;

passing toner amount detecting means for detecting or estimating an amount of a passing toner that passes the cleaner means; and cleaner control means for controlling, on the basis of an amount of passing toner detected by the passing toner amount detecting means, a cleaning operation by the cleaner means such that the amount of passing toner reaches a target value.

19. An image forming apparatus according to claim 18, wherein the passing toner amount detecting means estimates the amount of passing toner by measuring an amount of toner remaining on the image bearing means before a cleaning operation by the cleaning means is performed after the transfer.

20. An image forming method of forming an electrostatic latent image on a surface of an image bearing member, supplying a toner to visualize the latent image with the toner, transferring an image visualized using the toner to a transfer member, and removing a residual toner remaining on the surface of the image bearing member with a cleaner, the image forming method comprising:

detecting or estimating an amount of the toner that is not removed from the image bearing member by the cleaner and remains on the image bearing member to pass the cleaner;

setting a target value of the amount of the passing toner on the basis of a result of the detection or the estimation; and controlling the cleaner with respect to the target value.

* * * * *